US007509063B2

(12) United States Patent
Kimura et al.

(10) Patent No.: US 7,509,063 B2
(45) Date of Patent: Mar. 24, 2009

(54) ADJUSTMENT MODE CONTROL METHOD AND APPARATUS FOR PERFORMING THE SAME

(75) Inventors: Kuniyasu Kimura, Toride (JP); Naoto Watanabe, Abiko (JP); Yukio Yokoyama, Sakado (JP); Hiroto Nishihara, Toride (JP); Takako Hanada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 258 days.

(21) Appl. No.: 11/538,660

(22) Filed: Oct. 4, 2006

(65) Prior Publication Data

US 2007/0091390 A1 Apr. 26, 2007

(30) Foreign Application Priority Data

Oct. 5, 2005 (JP) ..... 2005-293006

(51) Int. Cl.
*G03G 15/08* (2006.01)

(52) U.S. Cl. ..... 399/27; 399/82

(58) Field of Classification Search ..... 399/9, 399/11, 24, 25, 26, 27, 28, 29, 38, 43, 81, 399/82, 85, 87; 358/1.14, 1.9, 406
See application file for complete search history.

(56) References Cited

U.S. PATENT DOCUMENTS

| | | | |
|---|---|---|---|
| 5,305,058 | A | 4/1994 | Sulenski et al. |
| 5,950,036 | A | 9/1999 | Konishi |
| 6,122,461 | A | 9/2000 | Shinohara |
| 2003/0137577 | A1 | 7/2003 | Shinohara |
| 2006/0215212 | A1* | 9/2006 | Tao ..... 358/1.14 |
| 2008/0075488 | A1* | 3/2008 | Moriyama et al. ..... 399/43 |

FOREIGN PATENT DOCUMENTS

| | | | |
|---|---|---|---|
| EP | 0 825 553 | A2 | 2/1998 |
| EP | 1 321 827 | A2 | 6/2003 |
| JP | 5-100535 | A | 4/1993 |
| JP | 5-216317 | A | 8/1993 |
| JP | 10-142857 | A | 5/1998 |
| JP | 2002-278177 | A | 9/2002 |
| JP | 2005-111913 | A | 4/2005 |
| JP | 2005-121850 | A | 5/2005 |
| JP | 2005-172867 | A | 6/2005 |

OTHER PUBLICATIONS

Relevant portion of Extended European Search Report of corresponding European Patent Application No. 06121747.7-2209, dated Jan. 25, 2007.

* cited by examiner

*Primary Examiner*—Hoan H Tran
(74) *Attorney, Agent, or Firm*—Rossi, Kimms & McDowell, LLP

(57) ABSTRACT

An adjustment time reduction mode of reducing adjustment operation time is provided such that a user can set the adjustment time reduction mode in which a user arbitrarily reduces the adjustment operation time, depending on the user's situation. An apparatus performing adjustment operation at a predetermined timing, monitors a timing at which the adjustment operation is to be performed and visually notifies a user of the timing at which the adjustment operation is to be performed before execution of a job requested by the user. When the adjustment time reduction mode is set, the apparatus reduces a time for the adjustment operation during execution of the job requested by the user, and the apparatus is caused to operate in the adjustment time reduction mode until the job is completed.

14 Claims, 23 Drawing Sheets

ADJUSTMENT MODE CONTROL METHOD AND APPARATUS FOR PERFORMING THE SAME

BACKGROUND OF THE INVENTION

1. Field of the Invention

The present invention relates to an adjustment mode control method and an apparatus of performing the control method and, more particularly, to an adjustment mode control method in an image forming apparatus using electrophotographic method and the image forming apparatus.

2. Description of the Related Art

In an image forming apparatus such as a printing machine, copying machine, or printer, various types of adjustment operations for maintaining image quality at regular intervals based on the number of sheets that have passed through the image forming apparatus or an elapsed time are performed to maintain a certain level of image quality. Along with recent full-scale transition of image forming apparatuses from black-and-white to color, a number of adjustment operations performed during output operation to maintain image quality has been increasing. As a result, the proportion of the time for adjustment operations performed during output operation is becoming larger.

Accordingly, for example, even if a user wants to quickly produce a small number of output sheets, the user must wait to obtain the output sheets till adjustment operations performed during output operation have been finished.

Adjustment operations of an image forming apparatus are performed for the purpose of maintaining the highest image quality of an image forming apparatus. However, for certain users, the minimum image quality required to correctly read characters may be sufficient to produce an output which is naturally expected to be only confirmed and discarded later like a trial output for check. Thus, some users do not want an increase in output time caused by interrupts of adjustment operations during output operation.

As described above, there is demand for an image forming apparatus which can shorten output time by minimizing adjustment operations performed during output operation depending on a situation in which a user is placed, desired image quality, or user setting.

Against the background, conventional techniques for reducing the time for adjustment operations during output operation include in JPA 10-142857. In JPA 10-142857, when a timer exceeds a predetermined period of time, it is set to execute adjustment operation is at that time. However, if image formation operation is being executed when the timer has exceeded the predetermined period of time, the start of adjustment operation is delayed until the executed image formation operation finishes. This prevents adjustment operations of image forming conditions automatically performed from interfering with a user's image formation work. As described above, in JPA 10-142857, an image forming apparatus performs adjustment operations while it is not in output operation. This has the effect of minimizing the time for adjustment operations performed during output operation.

In JPA 2002-278177, in an image forming apparatus which performs image density adjustment operation, when it is set to inhibit image density adjustment operation, the apparatus does not perform image density adjustment operation.

However, in JPA 10-142857, adjustment operations for maintaining image quality are performed only while image formation operation is not performed. Accordingly, even when, e.g., output operation is produced in large quantity, adjustment operations cannot be performed during the output operation and then there are restrictions on maintaining image quality.

In JPA 2002-278177, adjustment operations are inhibited by settings made by a service operator with specialized knowledge. The intended object of JPA 2002-278177 is to provide a technique for shortening installation time for installing an image forming apparatus. If the same technique is applied to a general user and the user is allowed to arbitrarily inhibit adjustment operations, the user needs to determine whether or not to inhibit adjustment operations. It is difficult for the user to make such a determination and then the user may erroneously inhibit adjustment operations.

As has been described above, according to a conventional technique, the number of times of adjustment operation cannot be reduced by a user easily and optionally changing a timing at which adjustment operation is to be performed or by a user easily and optionally extending an interval to perform adjustment operations. Also, it is impossible for a user to easily and arbitrarily set an adjustment shortening mode in which the time for adjustment operations during image output operation is shortened by performing simple substitute adjustment operations to be on, depending on a situation in which the user is placed or desired image quality.

According to a conventional technique, it is impossible for a user to know in advance a time at which adjustment operation is to be performed during output operation before the user starts image output. For this reason, when a plurality of image forming apparatuses with the same specifications are placed, an apparatus which is to perform adjustment operation soon may be selected without a user's intention on a request to quickly produce several output sheets.

Even if an apparatus has the function of setting the adjustment shortening mode to be on, when a user cannot know in advance before starting image output that adjustment operation is to be performed during output operation, the user cannot determine whether or not to set the adjustment shortening mode to be on.

SUMMARY OF THE INVENTION

An object of the present invention, to solve the conventional problems as described above, is to have an adjustment time reduction mode of reducing adjustment operation time to allow a user to set the adjustment time reduction mode in which a user arbitrarily reduces the adjustment operation time to be on, depending on the user's situation. Another object of the present invention is to improve user operability by notifying a user of information on adjustment operations such as the timing to the start of adjustment operation, the number of output sheets, an interval to perform adjustment operation, and adjustment operation time, and making the user determine easily whether or not to make a setting for a reduction of the adjustment operation time.

To achieve the above objects, the present invention provides an apparatus which performs adjustment operation at a predetermined timing, comprising: monitoring unit adapted to monitor a timing at which the adjustment operation is to be performed; and notification unit adapted to visually notify a user of the timing at which the adjustment operation is to be performed before execution of a job requested by the user. With this configuration, a user is notified of whether adjustment operation is to be performed. This makes it possible to, e.g., select an apparatus which is to perform processing.

The apparatus further comprises setting unit adapted to set an adjustment time reduction mode of reducing a time for the adjustment operation during execution of the job requested by the user; and control unit adapted to, when the adjustment time reduction mode is set by the setting unit, cause the apparatus to operate in the adjustment time reduction mode until the job is completed. Provision of the apparatus makes it possible to prevent processing time from being extended due to adjustment operation performed during processing operation depending on a situation in which a user is placed or desired quality.

In the adjustment time reduction mode, the time for the adjustment operation during execution of the job is reduced by making an interval to perform the adjustment operation longer than a normal interval of adjustment operation execution. In the adjustment time reduction mode, the time for the adjustment operation during execution of the job is reduced by performing adjustment operation executable for a shorter time than a time required for normal adjustment operation. The adjustment operation which has not been performed due to the adjustment time reduction mode is performed after the end of the job, for which the adjustment time reduction mode is set. This makes it possible to maintain quality of the apparatus at a time other than during operation.

The present invention also provides an image forming apparatus which performs adjustment operation at a predetermined timing, comprising: monitoring unit adapted to monitor a timing at which the adjustment operation is to be performed; and notification unit adapted to visually notify a user of the timing at which the adjustment operation is to be performed before execution of a job requested by the user.

When this invention is applied to an image forming apparatus, the adjustment operation includes toner density adjustment operation for adjusting the amount of toner to be replenished, and in the adjustment time reduction mode, a time interval, at which adjustment operation for forming a toner patch image and correcting the amount of toner to be replenished on the basis of a density value of the toner patch image detected by density detection means is performed, is extended by increasing a threshold value for a printed dot count, which is a condition for execution of the adjustment operation. Alternatively, the adjustment operation includes image density adjustment operation for adjusting a potential of a photosensitive drum, and in the adjustment time reduction mode, a time, for which adjustment operation for controlling a pre-exposure condition such that a charging characteristic of the photosensitive drum falls within a predetermined range is performed, is shortened by reducing the number of times at which measurement of the charging characteristic and change of the pre-exposure condition are repeated. The adjustment operation also includes color misalignment adjustment operation for correcting color misalignment of a color component at the time of color image formation.

The present invention further provides a method of controlling an apparatus which performs adjustment operation at a predetermined timing, comprising the steps of: monitoring a timing at which the adjustment operation is to be performed; visually notifying a user of the timing at which the adjustment operation is to be performed before execution of a job requested by the user; setting an adjustment time reduction mode of reducing a time for the adjustment operation during execution of the job requested by the user; and causing the apparatus to operate in the adjustment time reduction mode until a job is completed, when the adjustment time reduction mode is set in the setting step.

As has been described above, according to the present invention, it is possible to minimize delay in output operation caused by interrupts of adjustment operations during the output operation, by providing the adjustment time reduction mode of reducing adjustment operation time and also a function of allowing a user to arbitrarily set the adjustment time reduction mode to be on.

Further, it is easy for a user to determine whether or not to make a setting for a reduction of adjustment operation time, by notifying the user of information on adjustment operations such as the timing to the start of adjustment operation, the number of output sheets, an interval to perform adjustment operation, and adjustment operation time.

According to the present invention, it is possible to provide an apparatus capable of minimizing delay in adjustment operation. For this reason, it is possible to provide an image forming apparatus with high usability which allows a user to easily change adjustment operation depending on a situation in which the user is placed or desired image quality.

Further features of the present invention will become apparent from the following description of exemplary embodiments with reference to the attached drawings.

DESCRIPTION OF THE EMBODIMENTS

An image forming apparatus according to an embodiment of the present invention will be explained in detail below with reference to the drawings. Note that although this embodiment will be explained with taking, as an example of the image forming apparatus, a copying machine which has a printer unit using electrophotography, the present invention is not limited to this embodiment. The present invention is intended to implement a reduction in the time for adjustment operations during processing in an apparatus which performs adjustment operations during processing without any degradation in the quality of processing. An apparatus of performing such a technical idea is also included in the present invention.

<Example of Configuration of Image Forming Apparatus of This Embodiment>

Figure 1:
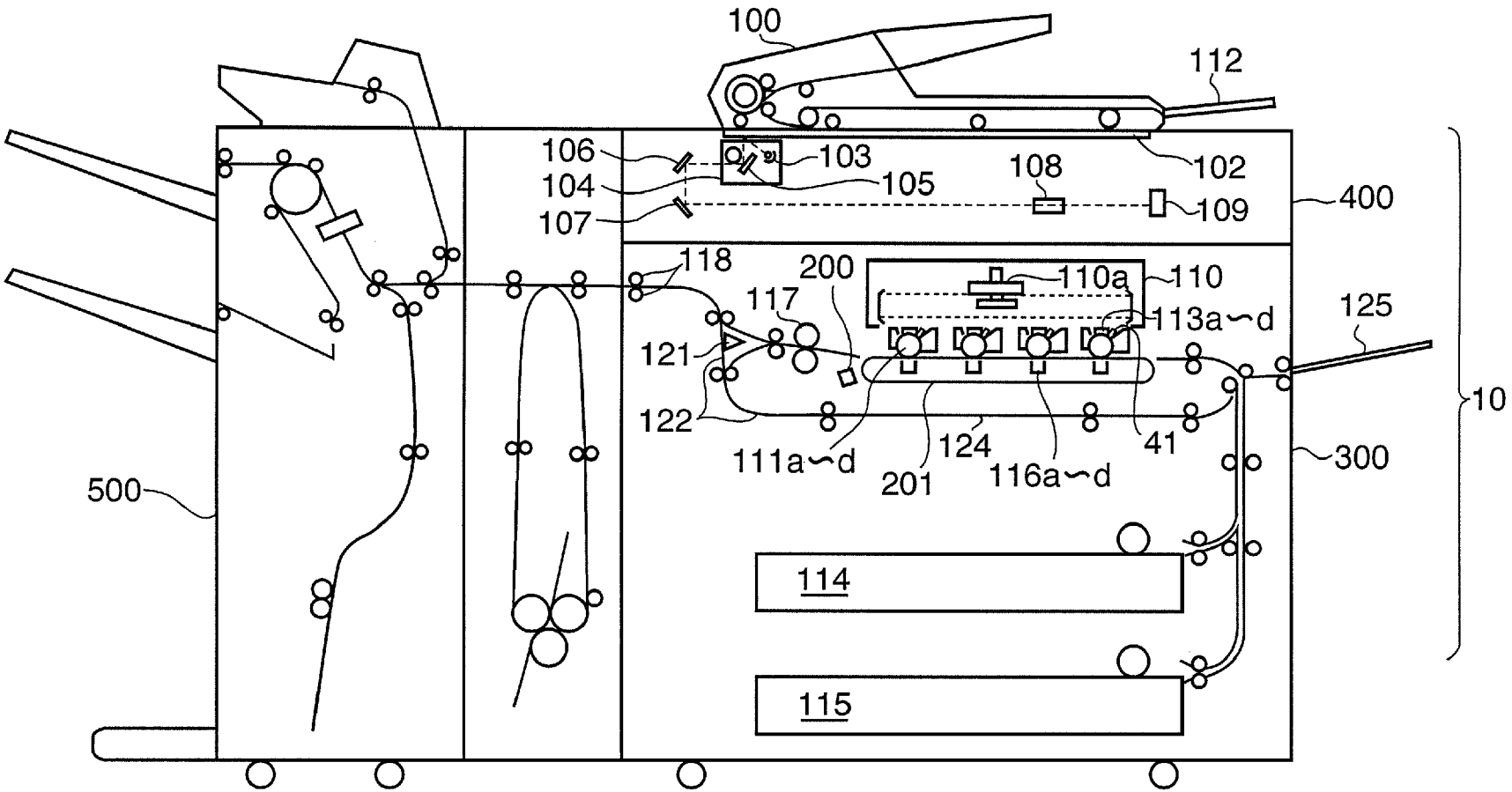
FIG. 1 is a view showing an example of the schematic configuration of an image forming apparatus of an embodiment.

FIG. 1 is a longitudinal sectional view showing the configuration of the main unit of the image forming apparatus of this embodiment.

As shown in FIG. 1, the image forming apparatus of this embodiment is composed of an image forming apparatus main body 10 and a post-processing apparatus 500. The main body 10 comprises an image reader 400 which reads a document image and a printer 300.

A document feeder 100 is mounted on the image reader 400. The document feeder 100 feeds document sheets set face-up on a document tray leftward one by one in order from the first page, passes each document sheet through a curved path, conveys the document sheet from left to right via a flow scanning position on a platen 102, and ejects it toward an external delivery tray 112. While each document sheet passes through the flow scanning position on the platen 102 from left to right, an image on the document sheet is scanned by a scanner unit 104 held at a location corresponding to the flow scanning position. The method is generally called document flow scanning. More specifically, while each document sheet passes through the flow scanning position, a scanning surface of the document sheet is irradiated with light of a lamp 103 of the scanner unit 104, and light reflected from the document sheet is guided to a lens 108 through mirrors 105, 106, and 107. The light having passed through the lens 108 forms an image on the image-sensing surface of an image sensor 109.

By conveying a document sheet such that the document sheet passes through the flow scanning position from left to right as described above, a document read scanning which uses a direction orthogonal to the conveying direction of the document sheet as a main scanning direction and the conveying direction as a sub-scanning direction is performed. That is, when the document sheet passes through the flow scanning position, the document sheet is conveyed in the sub-scanning direction while an image of the document sheet is scanned by the image sensor 109 line by line in the main scanning direction, thereby scanning an image of the entire document sheet. The image sensor 109 converts the optically read image into image data and output the image data. The image data output from the image sensor 109 is subjected to predetermined processing in an image signal control unit 230 (to be described later) and then input to an exposure control unit 110 of the printer 300 as a video signal.

Scanning of a document sheet can also be performed by a method in which the document feeder 100 conveys the document sheet onto the platen 102 and stops the document sheet at a predetermined location, and in this state, the scanner unit 104 scans the document sheet from left to right in the sub-scanning direction. This scanning method is the so-called document fixed scanning method.

When scanning a document sheet without the document feeder 100, a user first lifts up the document feeder 100 and places the document sheet on the platen 102. The scanner unit 104 scans the document sheet from left to right, thereby performing scanning of the document sheet. That is, when scanning a document sheet without the document feeder 100, document fixed scanning is performed.

The exposure control unit 110 of the printer 300 modulates and outputs laser light on the basis of the input video signal. The laser light is applied to photosensitive drums 111*a* (Y: Yellow), 111*b* (M: Magenta), 111*c* (C: Cyan), and 111*d* (Bk/K: Black) while being scanned by a polygon mirror 110*a*. An electrostatic latent image corresponding to the scanned laser light is formed on each of the photosensitive drums 111*a* to 111*d*. The exposure control unit 110 outputs laser light at the time of document fixed scanning such that a correct image (not a mirror image) is formed, as will be described later.

The electrostatic latent images on the photosensitive drums 111*a* to 111*d* are made visible as developer images with developers supplied from developing units 113*a* (Y), 113*b* (M), 113*c* (C), and 113*d* (Bk/K). In synchronism with the start of irradiation with laser light, a sheet is fed from a cassette 114 or 115, a manual paper feeding unit 125, or a double-sided conveying path 124, and the sheet is conveyed to between the photosensitive drums 111*a* to 111*d* and transfer units 116*a* to 116*d*. The developer images formed on the photosensitive drums 111*a* to 111*d* are transferred onto the fed sheet by the transfer units 116*a* to 116*d*.

A conveying belt 201 conveys a sheet and is also used as a medium on which a patch image is formed in patch detection ATR (Auto Toner Replenishment) for correction of the amount of toner to be replenished in this embodiment. A density detecting sensor 200 detects the density of a patch image formed on the conveying belt 201. Note that a sensor which measures the potential of the surface of a drum used for image density adjustment operation of this embodiment is not shown to avoid overcrowding in the drawing.

The sheet, onto which the developer images have been transferred, is conveyed to a fixing unit 117. The fixing unit 117 heats and presses the sheet with fixing rollers (not shown), thereby fixing the developer images on the sheet. The sheet having passed through the fixing unit 117 is ejected from the printer 300 to the outside through a flapper 121 and discharge rollers 118.

When a sheet is to be ejected with the image-forming side down (face-down), the sheet having passed through the fixing unit 117 is first guided to a reversing path 122 by switching operation of the flapper 121. After the trailing edge of the sheet passes through the flapper 121, the sheet is reversed and ejected from the printer 300 by the discharge rollers 118. Sheet ejection of this type will be referred to as reversal sheet ejection hereinafter. Reversal sheet ejection is performed when images are formed in order from the first page, such as when images read using the document feeder 100 are formed or when images output from a computer are formed. Ejected sheets are correctly ordered by page.

When a hard sheet such as an overhead transparency film is fed from the manual paper feeding unit 125 to form an image thereon, the sheet is ejected with the image-forming side up (face-up) by the discharge rollers 118 without guiding the sheet to the reversing path 122.

If the image forming apparatus is set to perform double-sided recording, which forms images on both sides of a sheet, a sheet is guided to the reversing path 122 by switching operation of the flapper 121 and then conveyed to the double-sided conveying path 124. Control is performed such that the sheet, having been guided to the double-sided conveying path 124, is fed again to between the photosensitive drums 111*a* to 111*d* and the transfer units 116*a* to 116*d* at a time described above.

The sheet ejected from the printer 300 is sent to the post-processing apparatus 500. The post-processing apparatus 500 performs processes such as binding processing, stapling processing, and punching.

(Example of Configuration of Control Unit in Image Forming Apparatus of This Embodiment)

Figure 2A:
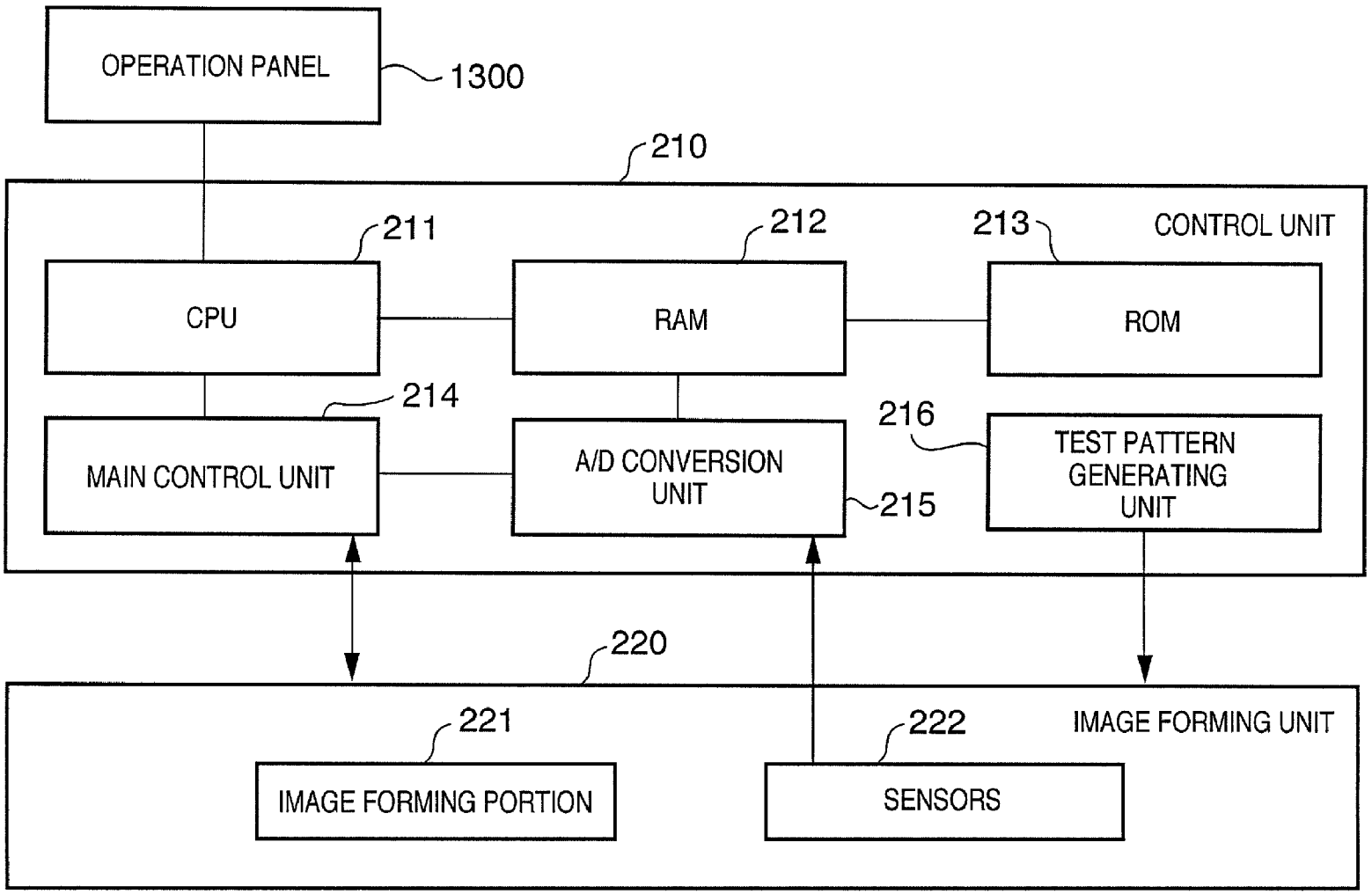
FIG. 2A is a block diagram showing an example of the configuration of a control unit of the image forming apparatus of this embodiment.

FIG. 2A is a block diagram showing an example of the configuration of a control unit in the image forming apparatus of this embodiment. FIG. 2A shows the relationship between a control unit 210 which controls the entire image forming apparatus related to the processing of this embodiment and an image forming unit 220 which controls image formation. To avoid overcrowding, FIG. 2A shows only components strongly associated with the features of this embodiment.

The control unit 210 has a CPU 211 for arithmetic control. The control unit 210 also has RAM 212 for storing temporary data or a program used by the CPU 211 and ROM 213 for storing fixed data and software executed by the CPU 211 to operate the image forming apparatus. The control unit 210 also has a main control unit 214 which controls the operation of the image forming unit 220 and an A/D conversion unit 215 which receives analog data from various types of sensors of the image forming unit 220 and converts the analog data into digital data. The control unit 210 also has a test pattern generating unit 216 for generating a test pattern such as a density patch.

The image forming unit 220 has an image forming portion 221 composed of the exposure control unit 110, photosensitive drums 111*a* to 111*d*, developing units 113*a* to 113*d*, cassettes 114 and 115, manual paper feeding unit 125 or double-sided conveying path 124, transfer units 116*a* to 116*d*, and fixing unit 117. The image forming unit 220 also has various types of sensors 222 which monitor the states of the devices of the image forming portion 221. The image forming unit 220 forms an image corresponding to image data or a test pattern such as a density patch sent from the control unit 210 in accordance with an instruction from the main control unit 214. Data detected by the various types of sensors 222 are sent from the image forming unit 220 to the control unit 210 as occasion arises.

Figure 2B:
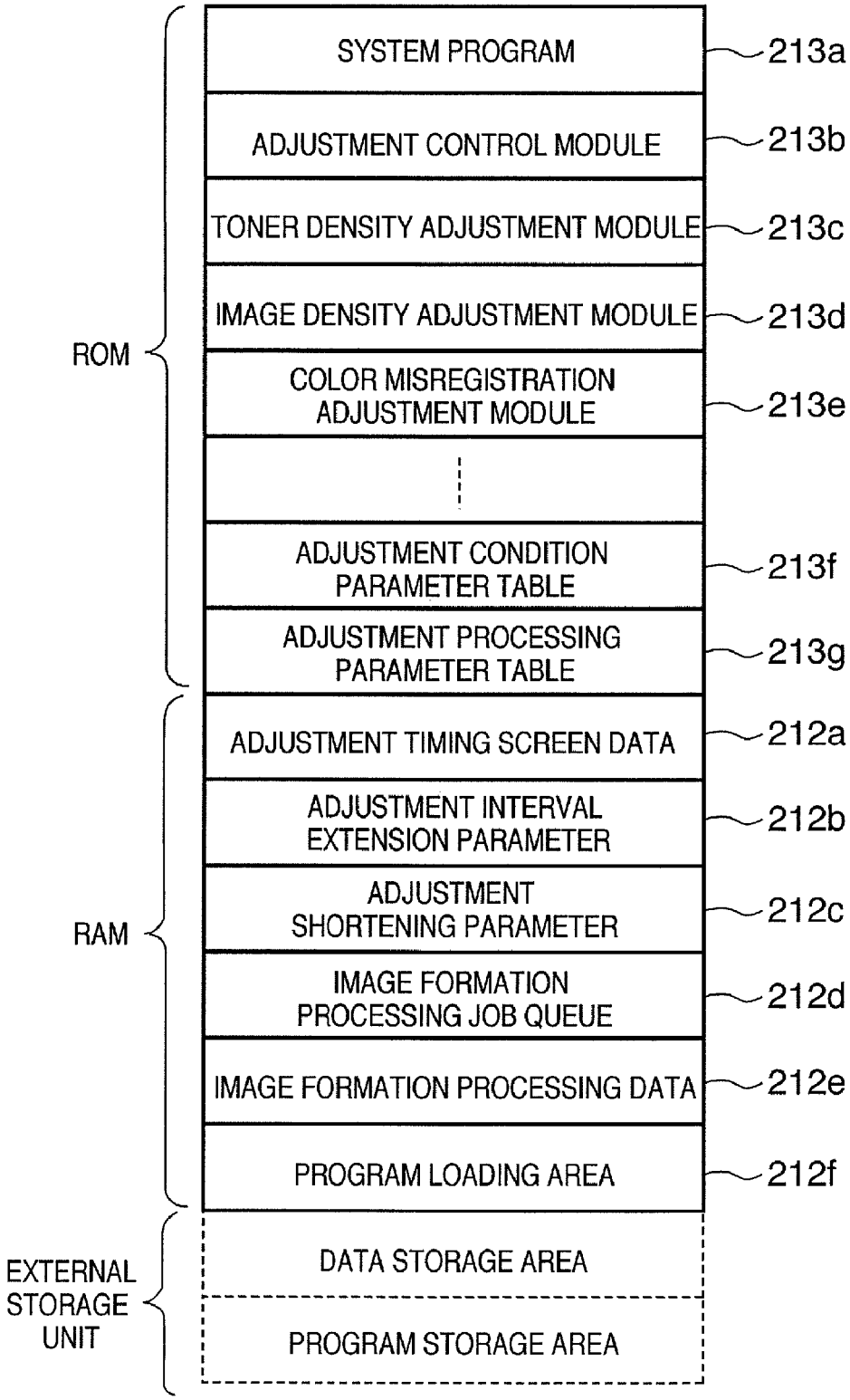
FIG. 2B is a chart showing an example of the memory configurations of ROM and RAM in FIG. 2A.

FIG. 2B shows an example of parts of the memory configurations of the ROM 213 and RAM 212 in the control unit 210 which are related to this embodiment. Note that FIG. 2B shows only areas closely associated with this embodiment.

Storage areas denoted by reference numerals 213*a* to 213*g* in FIG. 2B are reserved in the ROM 213 in FIG. 2A in this example. Reference numeral 213*a* denotes a system program which operates the image forming apparatus and is a versatile OS or special-purpose program. Reference numeral 213*b* denotes an adjustment control module which controls the time for adjustment operations during image formation processing (execution of a job) of this embodiment. Reference numeral 213*c* denotes a toner density adjustment module which controls toner density adjustment operation shown below as an example of adjustment time control of this embodiment. Reference numeral 213*d* denotes an image density adjustment module which controls image density adjustment operation shown below as another example of adjustment time control of this embodiment. Reference numeral 213*e* denotes a color misalignment adjustment module which controls color misalignment adjustment operation as still another example of adjustment time control of this embodiment.

Reference numeral 213*f* denotes an adjustment condition parameter table which stores conditions for starting adjustment operations. For example, as for toner density adjustment operation shown in this embodiment, default threshold values for the accumulated values of video counts (to be described later) are stored. Reference numeral 213*g* denotes an adjustment processing parameter table which stores adjustment processing parameters used in the adjustment operations. For example, as for image density adjustment operation shown in this embodiment, a default variation width of a pre-exposure input voltage (to be described later), 2.0 V is stored.

Storage areas denoted by reference numerals 212*a* to 212*f* are reserved in the RAM 212 in FIG. 2A in this example. Note that if parameters to be stored in the storage areas have fixed values, they may be stored in the ROM 213. Reference numeral 212*a* denotes an area which stores data for adjustment timing screens shown in FIGS. 4, 5, and 17 below. Reference numeral 212*b* denotes parameters for interval extension, each of which is used when an instruction is given to extend interval for one of the adjustment operations. For example, for toner density adjustment operation shown in this embodiment, a threshold value for the accumulated value of video counts (to be described later) which is obtained by changing the original threshold value to a higher value is stored. Reference numeral 212*c* denotes an adjustment shortening parameter table which stores parameters for adjustment shortening used in the adjustment operations. For example, for image density adjustment operation shown in this embodiment, an expression or a coefficient k for calculating the variation width of the pre-exposure input voltage (to be described later) is stored.

Reference numeral 212*d* denotes an image formation processing job queue which stores a job to be executed by the image forming apparatus. Reference numeral 212*e* denotes image formation processing data which is subjected to formation processing in the image forming apparatus. Reference numeral 212*f* denotes an area into which a program is loaded when the program is loaded from an external storage unit such as a disk and executed by the CPU 211.

The external storage unit (not shown in FIG. 2A) includes a data storage area and a program storage area.

<Example of Operation of Image Forming Apparatus of This Embodiment>

Figure 3A:
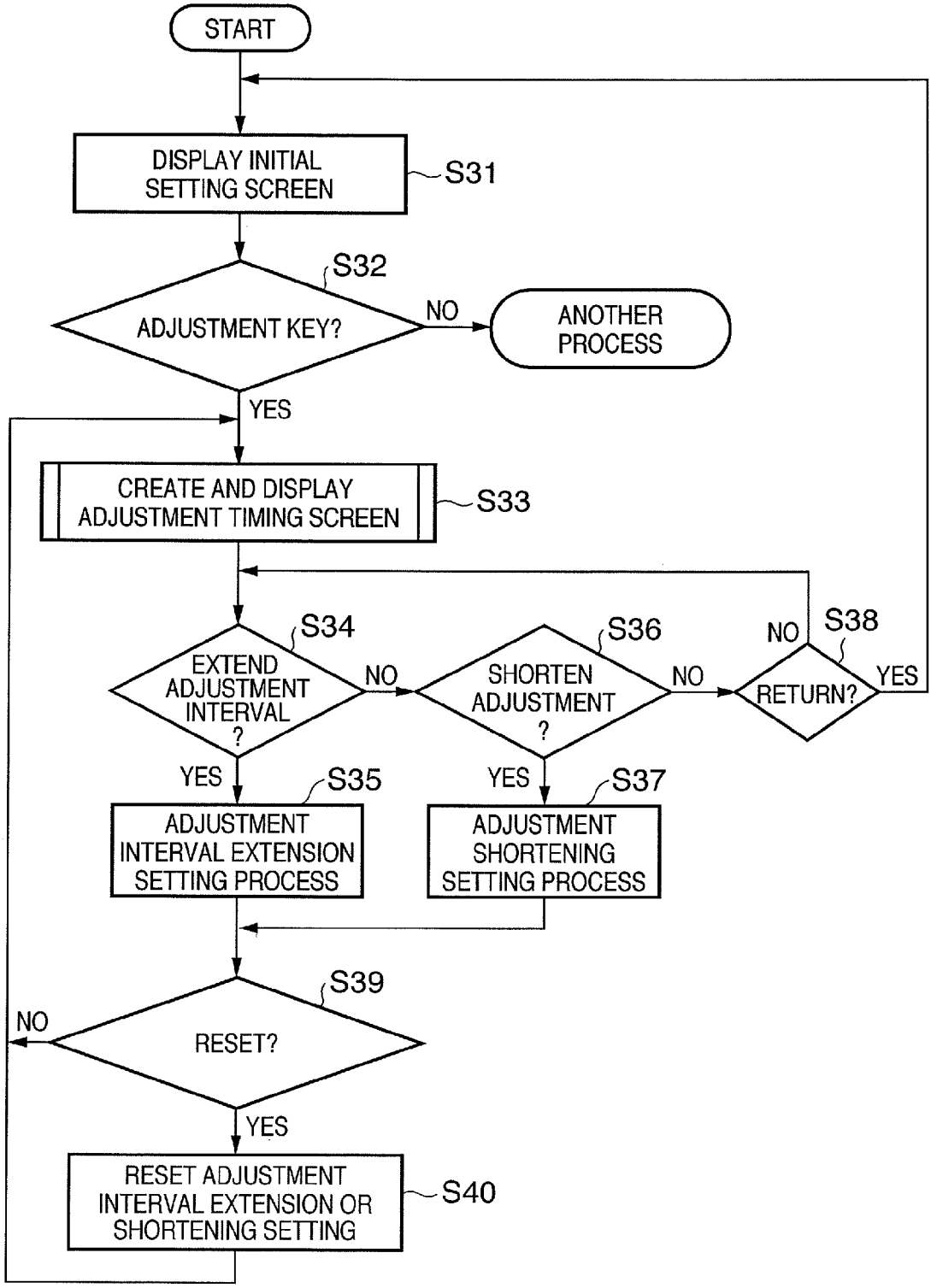
FIG. 3A is a flowchart showing an example of a control procedure at the start of a job in the image forming apparatus of this embodiment.
Figure 3B:
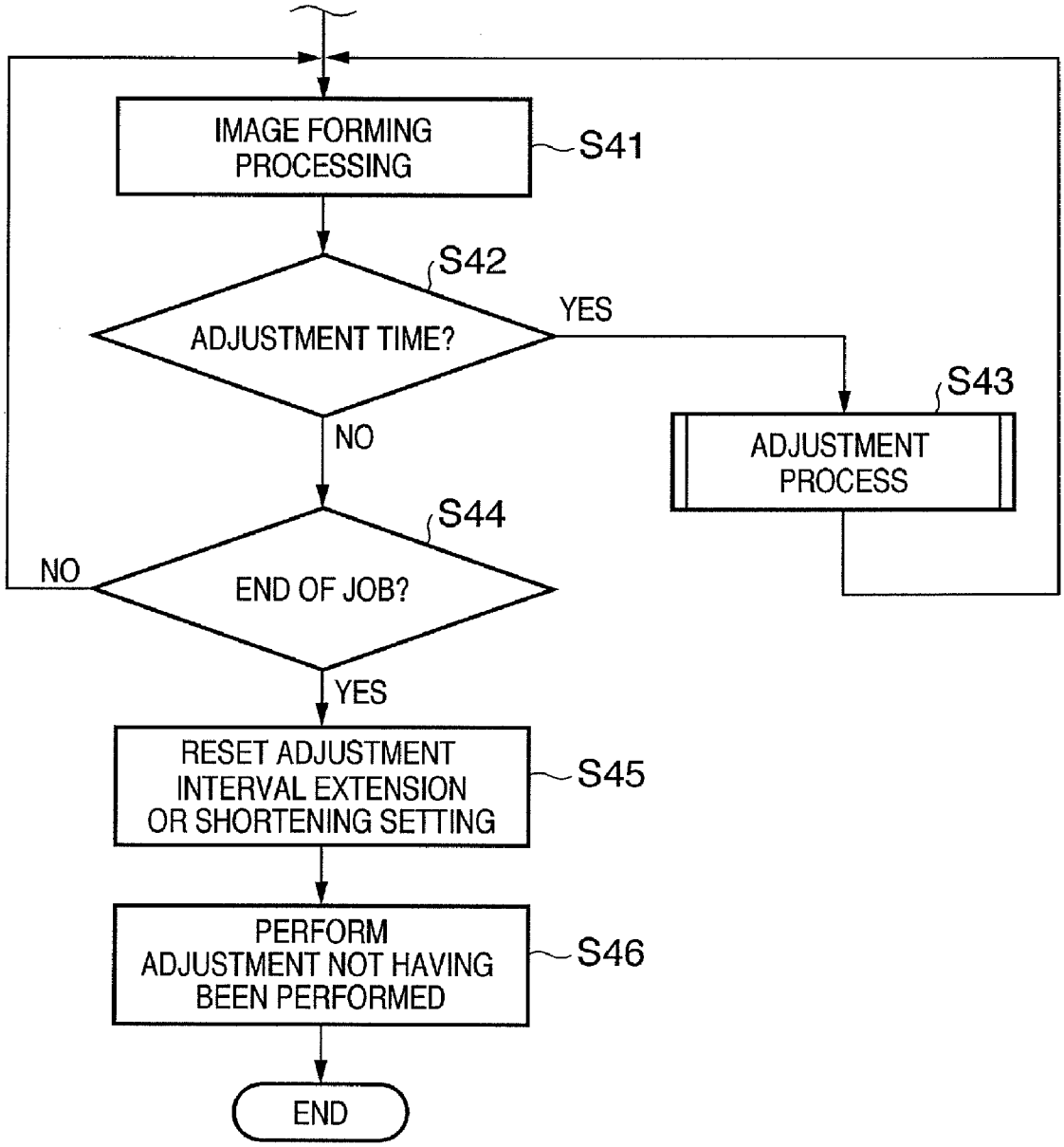
FIG. 3B is a flowchart showing an example of a control procedure at the end of a job in the image forming apparatus of this embodiment.

FIGS. 3A and 3B are flowcharts showing examples of the procedures for adjustment control of the image forming apparatus of this embodiment. FIG. 3A shows an example of the processing procedure at the start of a job; and FIG. 3B, an example of the processing procedure at the end of a job.

Figure 4:
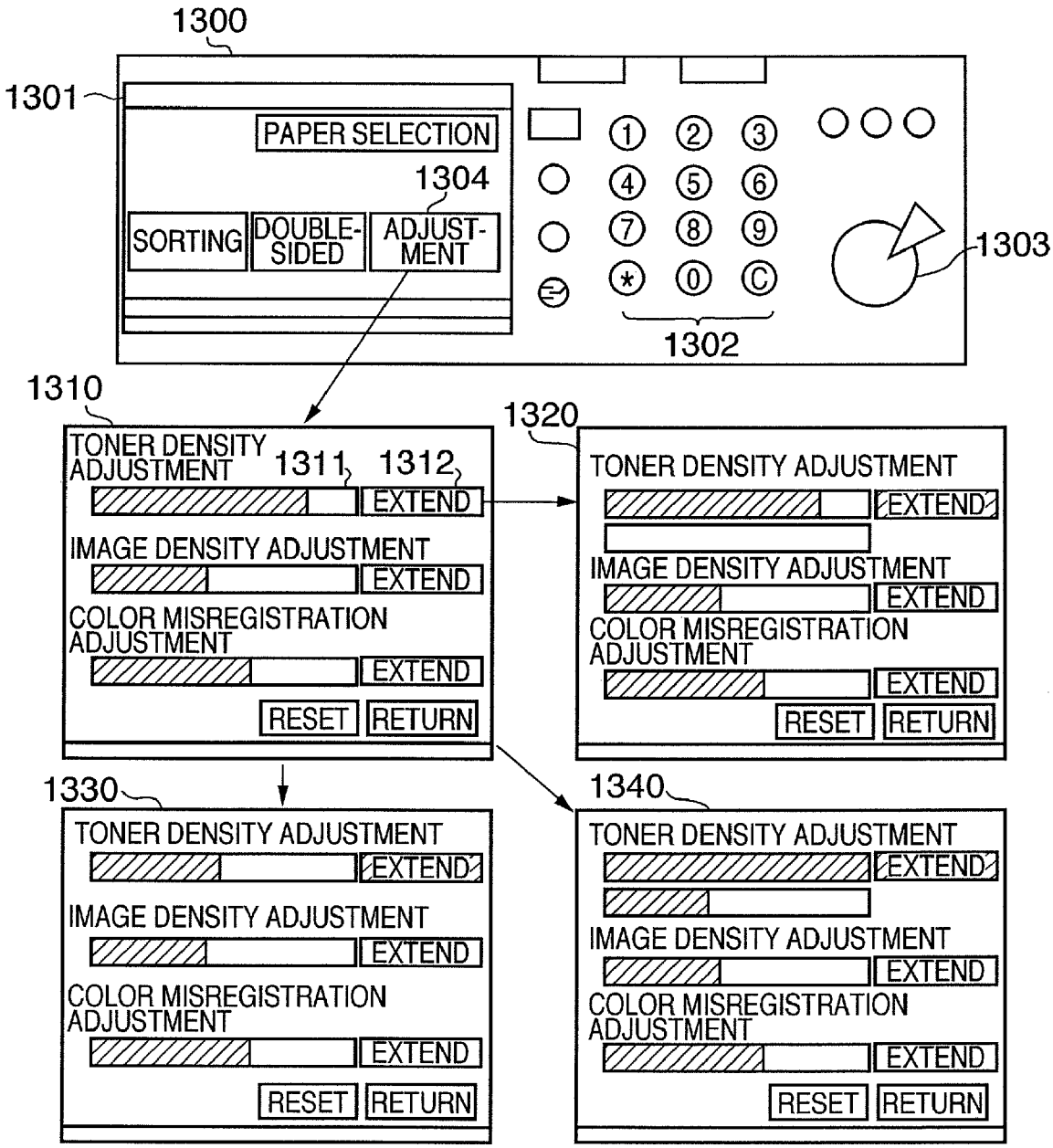
FIG. 4 is a view for explaining an example of adjustment timing and extension of adjustment interval in an operation panel according to this embodiment.

In step S31, a menu for operating the image forming apparatus is displayed as an initial setting screen (see FIG. 4). In step S32, it is determined whether an "Adjustment" key is designated on the initial setting screen. If any of processes other than "adjustment" is designated, the process is executed in accordance with the designation. The processes other than adjustment operations include "print" processing.

If the "Adjustment" key is designated, the flow advances to step S33. In step S33, an adjustment timing screen is created and displayed (see FIGS. 4, 5, and 17). The flow branches to different processes depending on which key is designated on the adjustment timing screen. If an "Extend" key is designated, the flow advances from step S34 to step S35 to make a corresponding adjustment interval extension setting (by changing a corresponding condition concerning adjustment timing). If a "Shorten" key is designated, the flow advances from step S36 to step S37 to make a corresponding adjustment time shortening setting. If a "Return" key is designated, the flow returns from step S38 to step S31 to display the initial setting screen.

In step S39, it is determined whether a "Reset" key for resetting an "extension" or "shortening" setting made is designated. If the "Reset" key is designated, the flow advances to step S40. In step S40, the value of a corresponding adjustment time parameter is restored to its default value, and the flow returns to step S33. On the other hand, if the "Reset" key is not designated, the flow returns to step S33 without any processing.

FIG. 3B is a flowchart showing an example of the processing procedure at the end of a job.

It is determined in step S42 whether an adjustment timing has come during image formation processing in step S41. For example, as for toner density adjustment operation illustrated below, the determination is made on the basis of whether the accumulated value of video counts for any of colors has exceeded a threshold value. In contrast, as for image density adjustment operation, the determination is made on the basis of whether a predetermined time has elapsed or whether a predetermined amount of printout has been produced by print operation. If it is determined that an adjustment timing has come, the image formation processing is interrupted, and the flow advances to step S43 to perform an adjustment operation determined to be necessary. For example, in toner density adjustment operation illustrated below, a patch image is formed to detect the density of the image, a correction value for the amount of toner to be replenished is calculated, and the amount of toner to be replenished is adjusted. In contrast, in image density adjustment operation, a pre-exposure input voltage is adjusted while the potential of the surface of each drum to which a charging current is applied is measured. The adjustment operation is performed such that a variation width of the potential of the drum surface falls within a predetermined range. When the adjustment operation finishes, the flow returns to step S41 to resume the image formation processing.

If it is not determined in step S42 that an adjustment timing has come, it is determined in step S44 whether the end of the job has been reached. If the end has not been reached, the flow returns to step S41 to continue the image forming processing. On the other hand, if the end of the job has been reached, the flow advances to step S45 to reset an adjustment interval "extension" setting, adjustment "shortening" setting, and the like made by a user before the start of the job. In this example, parameters to be used are switched from parameters stored in the RAM 212 to corresponding reference parameters stored in the ROM 213. In step S46, adjustment operations not having been performed during execution of the job are performed. If an "extension" setting is made, since adjustment operations which normally need to be performed are not performed during a job, the adjustment operations not having been performed are performed at the end of the job. This prevents degradation of image quality.

<Example of Extension of Toner Density Adjustment Interval as Example of Adjustment Interval Extension of This Embodiment>

In the image forming apparatus, several adjustment operations are performed to maintain the highest image quality. One of the operations, toner density adjustment operation will be explained below.

The color image forming apparatus of this embodiment adopts a development method which uses a two-component developer formed by mixing toner and carrier particles in the developing units 113*a* to 113*d*. When using such a two-component developer, it is necessary to keep the ratio between toner and carrier particles (T/C ratio) in each developing unit constant in order to maintain high image quality. As a schema to settle this object, toner density adjustment operation is performed.

Figure 7:
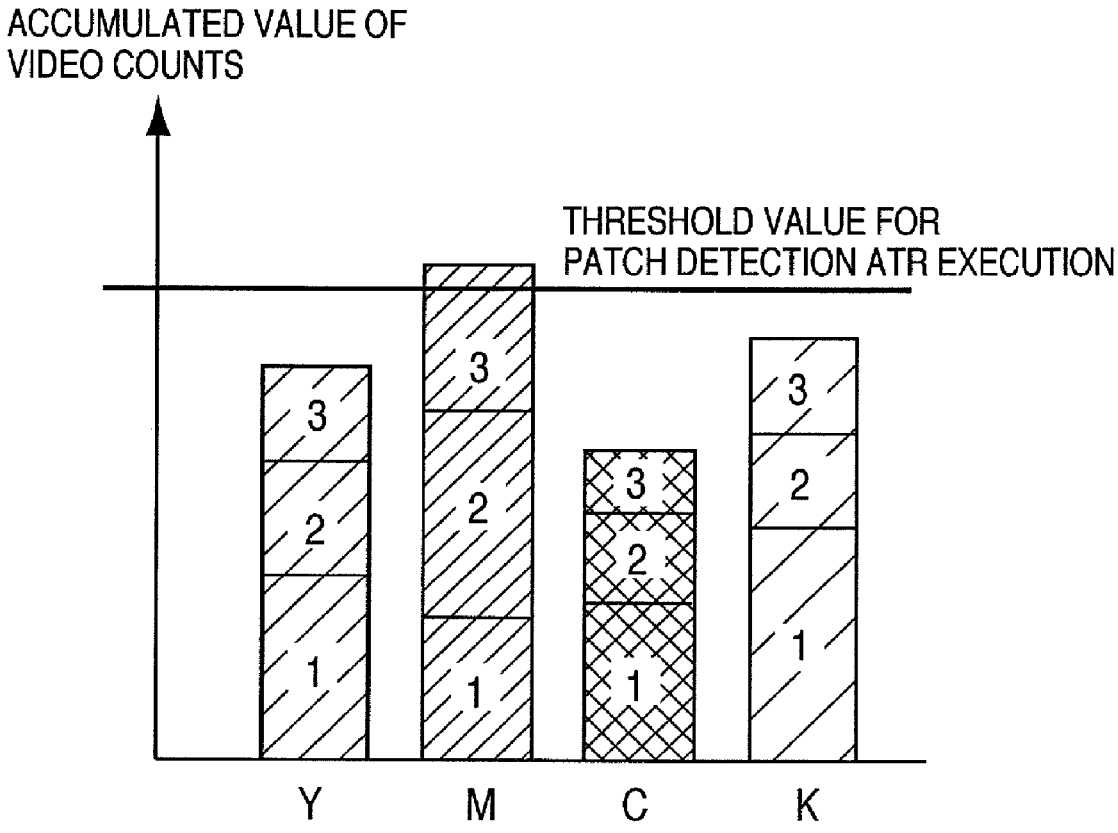
FIG. 7 is a graph showing an example of determination of a time at which toner density adjustment operation according to this embodiment is to be performed.

In toner density adjustment operation, the main control unit 214 accumulates, for each of colors, video counts obtained from image data. Toner density adjustment operation is executed when the accumulated value for any one of the colors has exceeded a threshold value for patch detection ATR execution, as shown in FIG. 7.

(Extension of Toner Density Adjustment Interval)

FIG. 4 is a view of the configuration of an operation panel 1300 provided on the front of the image reader 400.

Reference numeral 1301 denotes a display unit which displays an operating state and a message. The surface of the display unit 1301 constitutes a touch panel and works as a selection key when a corresponding portion thereof is touched. Reference numeral 1302 denotes a numeric keypad 1302 which is composed of keys for inputting the number of copies. Reference numeral 1303 denotes a start key. The operation starts by pressing the start key 1303.

Reference numeral 1304 denotes an adjustment timing display key. When the key 1304 is pressed, the initial display screen changes to an operation panel screen 1310. On the screen 1310, respective time intervals in which adjustment operations are regularly executed by the image forming apparatus according to this embodiment are displayed. For example, as for toner density adjustment operation, the right end of the filled portion of a timing bar 1311 indicates the largest value, which is the accumulated value of video counts for K (Black) of the accumulated values of video counts for colors in FIG. 8. The right end of the timing bar 1311 indicates the threshold value for patch detection ATR execution in FIG. 8. Accordingly, when the filled portion of the timing bar 1311 has reached the right end of the timing bar 1311, a condition for execution of adjustment operation is satisfied, and the corresponding automatic adjustment operation is executed. A key for resetting "extension" and "shortening" settings and a key for returning the display to the initial screen are also displayed on the screen.

Reference numeral 1312 denotes an adjustment interval extension key. When the key 1312 is pressed, the time interval between the corresponding adjustment operations is extended. In this embodiment, when the adjustment interval extension key 1312 for toner density adjustment operation is pressed, the time interval between the toner density adjustment operations is extended by increasing the threshold value for patch detection ATR execution, as in b and c of FIG. 8. For example, if the threshold value for patch detection ATR execution is increased to be twice the default value, the relationship between the accumulated values of video counts and the threshold value for patch detection ATR execution becomes as shown in b of FIG. 8. The maximum right end position of the corresponding timing bar 1311 is extended depending on the relationship, and the extended timing bar 1311 is displayed, as in an operation panel screen 1320.

Note that as another example, the maximum right end position of the timing bar 1311 may be left unchanged. The filled portion of the timing bar 1311 may be correspondingly shortened depending on the relationship, and the timing bar 1311 may be displayed including the shortened filled portion, as in an operation panel screen 1330.

Figure 8:
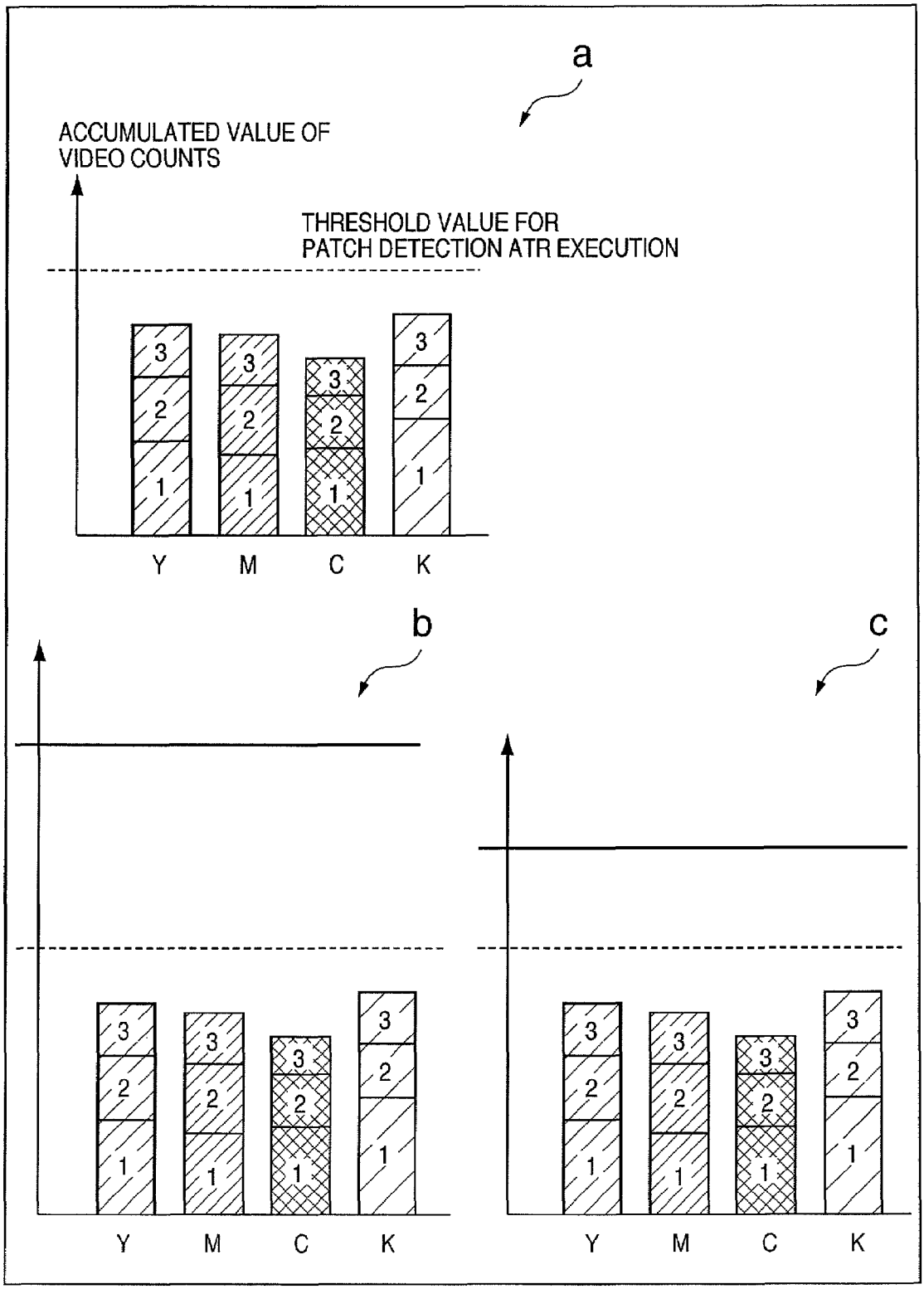
FIG. 8 shows graphs indicating examples of extension of a time interval at which toner density adjustment operation according to this embodiment is to be performed.

For example, if an extended interval is 1.5 times the default interval, as in c of FIG. 8, the timing bar 1311 is displayed depending on the relationship between the accumulated values of video counts and the threshold value for patch detection ATR execution, as in an operation panel screen 1340.

Figure 5:
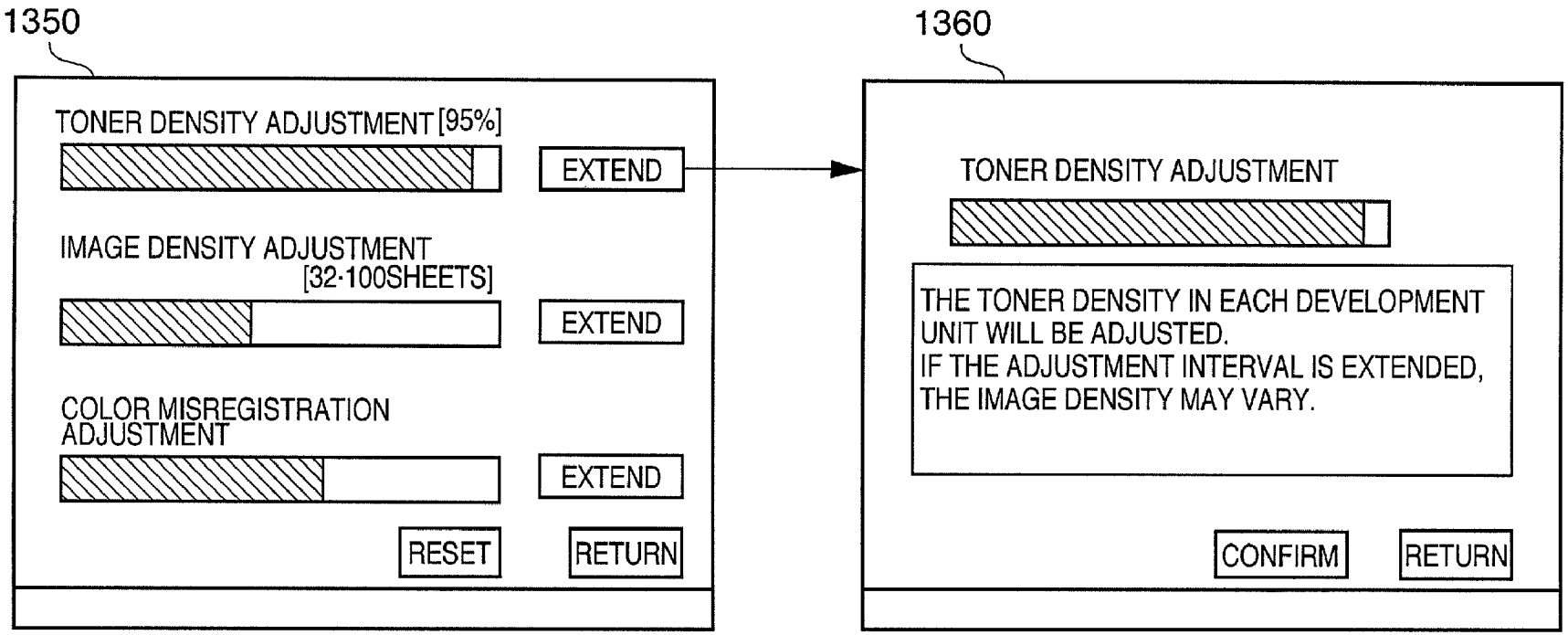
FIG. 5 is a view for explaining another example of adjustment timing and extension of adjustment interval in the operation panel according to this embodiment.

As still another example, timing information for adjustment operation execution may be added to each timing bar 1311, as in FIG. 5. Each piece of timing information may be percent information as shown in the field for toner density adjustment operation of an operation panel screen 1350, or information on the number of sheets as shown in the field for drum potential adjustment operation. As shown in an operation panel screen 1360, the operation panel screen 1350 can be configured to display a screen indicating the influence due to extension of adjustment interval, which prompts a user to confirm execution of the extension when the corresponding adjustment interval extension key is pressed.

If one of the adjustment interval extension keys is pressed before or at the start of a print job by a user, a threshold value for execution of the corresponding adjustment operation is increased as described above, and then the print job is performed. However, since the threshold value is increased so as to have no influence on an output image, when the accumulated value has reached to the increased threshold value during the print job, the corresponding adjustment operation is performed at that time. If the accumulated value has exceeded the original threshold value at the end of the print job, the corresponding adjustment operation is executed even when the accumulated value has not reached the increased threshold value.

(Toner Density Adjustment Operation)

Figure 6:
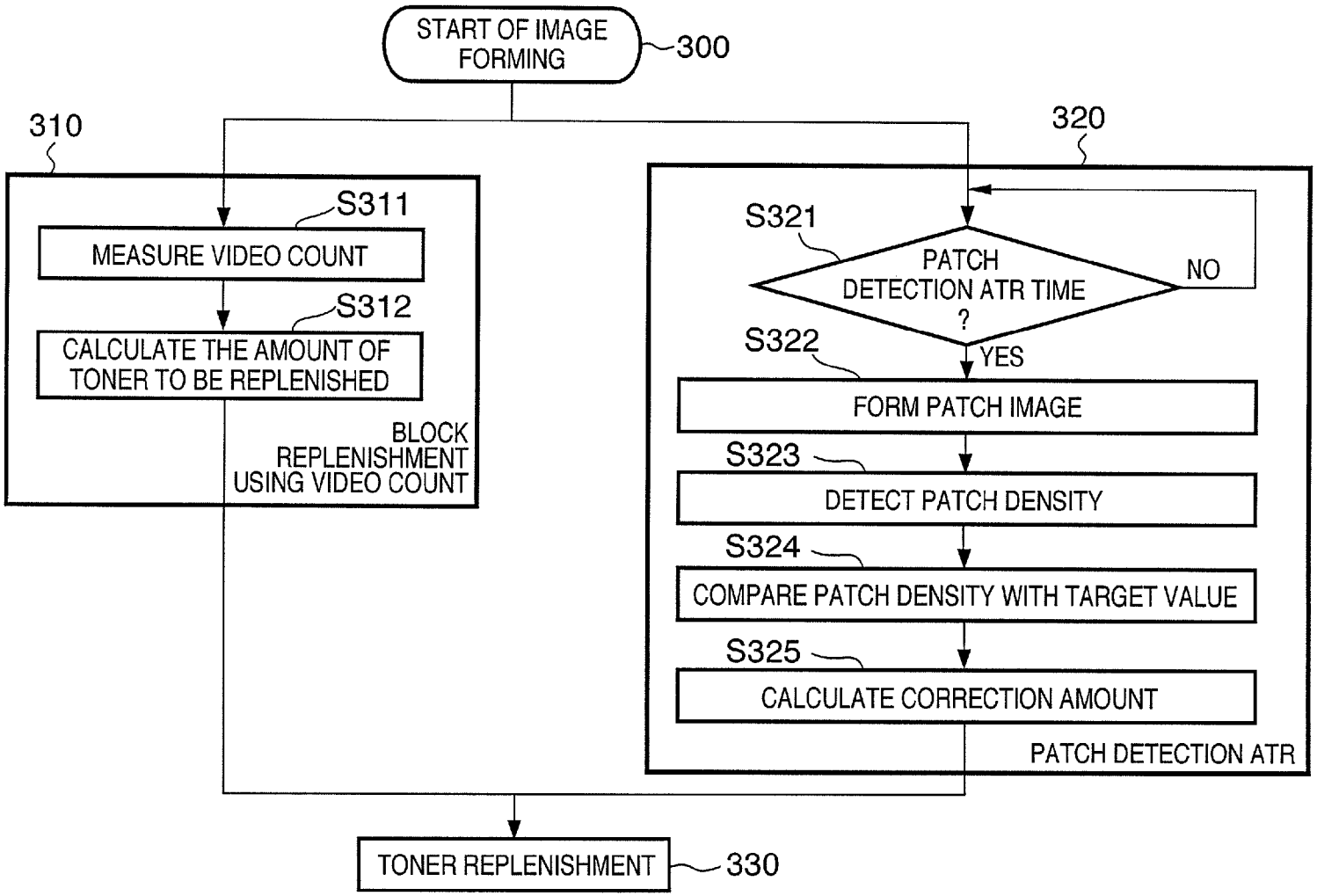
FIG. 6 is a flowchart showing an example of the procedure for toner density adjustment operation according to this embodiment.

FIG. 6 shows an example of control of toner density adjustment operation according to this embodiment.

Toner density adjustment operation is roughly divided into two operations. One is block replenishment operation 310 using video counts, and the other is patch detection ATR (Auto Toner Replenishment) 320 based on measurement of the density of a formed patch image.

In the block replenishment operation 310, each time when print operation is performed, the number of dots (video count) for each color is measured from image data (S311), and the consumed amount of toner is calculated using the number of dots (S312). After that, each of the developing units 113*a* to 113*d* is replenished with the optimum amount of toner in consideration of the calculated consumed amounts of toner with a result of the patch detection ATR.

In the patch detection ATR 320, toner patch (density patch) images are formed on the conveying belt 201, and the amount of toner to be replenished to each developing unit is corrected on the basis of a corresponding density value detected by the density detecting sensor 200. This operation combined with the block replenishment operation 310 keeps the T/C ratio in each developing unit constant with higher precision than the block replenishment operation alone.

The patch detection ATR 320 is executed when the main control unit 214 determines that a time at which the patch detection ATR is to be executed has come (S321). As described above, the main control unit 214 accumulates, for each of colors, video counts obtained from image data. The main control unit 214 executes the patch detection ATR when the accumulated value for any one of the colors has exceeded the threshold value for patch detection ATR execution, as shown in FIG. 7.

When it is determined that a time at which the patch detection ATR is to be executed has come, the main control unit 214 instructs the test pattern generating unit 216 to form a test pattern for patch density measurement. The test pattern generating unit 216 controls the units in the image forming portion 221 and forms density patches on the conveying belt 201 (S322). Density patches may be formed on the photosensitive drums 111*a* to 111*d*, respectively. However, in this case, a density detecting sensor needs to be provided for each of the photosensitive drums. In this embodiment, in order to reduce the number of density detecting sensors, density patches are formed on the conveying belt 201, and the one density detecting sensor 200 detects the density patches of all colors. The density detecting sensor 200 irradiates the density patches using a light source and detects the intensity of reflected light with a light-receiving sensor. A signal indicating the intensity of reflected light is A/D converted by the A/D conversion unit 215 and processed by the CPU 211.

(Example of Configuration of Density Detecting Sensor)

The density detecting sensor 200, which performs patch density measurement, will be explained. Generally, methods used by the density detecting sensor 200 are roughly divided into two methods, i.e., a method of detecting a diffused reflection component of reflected light and a method of detecting a specular reflection component of reflected light.

A method of detecting a diffused reflection component will be described in detail. A diffused reflection component is a reflection component sensed as color. Characteristically, the amount of diffused reflection light increases with an increase in the amount of a color material, i.e., the amount of toner in a density patch.

Figure 9:
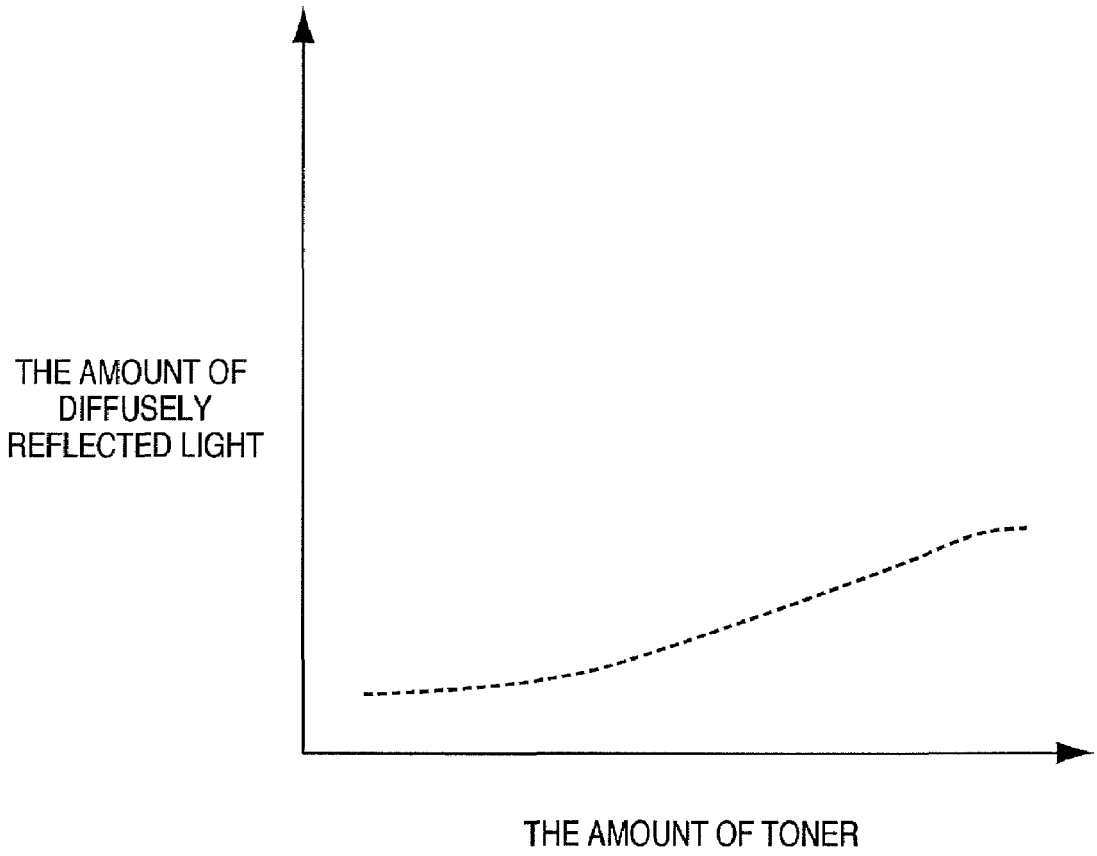
FIG. 9 is a graph showing an example of the relationship between the amount of diffusely reflected light and the amount of toner applied to the image forming apparatus of this embodiment.

FIG. 9 is a graph of the relationship between the amount of diffusely reflected light and the amount of toner (toner density) applied to the image forming apparatus of this embodiment.

Uniform diffusion of light reflected from a density patch in all directions is also characteristic of diffusely reflected light. A type of density detecting sensor which detects diffused reflection components is configured such that the irradiation angle and the receiving angle are different from each other, in order to eliminate the influence of specular reflection components (to be described later). However, when the type of density sensor which detects diffused reflection detects the density of black toner, it cannot detect light reflected from the black toner because the black toner absorbs light. To cope with this, there has also been devised, e.g., a method in which a background in a chromatic color is used as the background of density patches, and the density of black toner is detected by measuring the amount of light reflected from the background hidden under black toner particles. However, a conveying belt 201 serving as a background on which patch images are formed needs to adjust resistance value in order to securely maintain a sheet conveying force. In this reason, carbon black is scattered over a conveying belt 201, and then the color of the conveying belt 201 is often black or dark gray. If an attempt is made to detect the density of black toner on the conveying belt 201, no light is reflected from density patches and the background, and the type of density sensor which detects diffused reflection component cannot detect the black toner. Thus, it is necessary to use a type of density sensor which detects specularly reflected light (to be described later).

Figure 10:
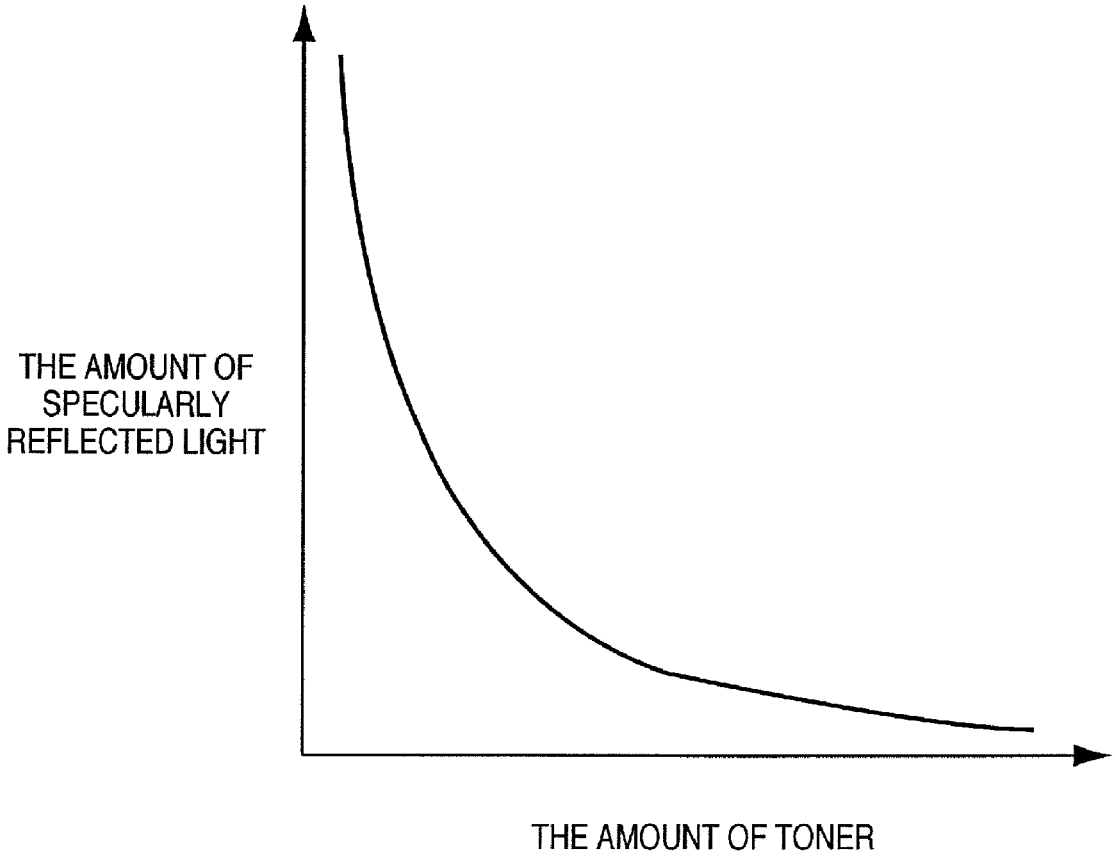
FIG. 10 is a graph showing an example of the relationship between the amount of specularly reflected light and the amount of toner applied to the image forming apparatus of this embodiment.

FIG. 10 is a graph of the relationship between the amount of specularly reflected light and the amount of toner. A method of detecting a specular reflection component of reflected light will be described in detail below.

A type of density sensor which detects specularly reflected light detects light reflected in a direction symmetrical to the irradiation angle with respect to the normal of a background surface (conveying belt surface). The amount of the specularly reflected light depends on the refractive index specific to the material for the background and the reflectance determined by the surface state, and is sensed as gloss. If density patches are formed on the background, parts of the background with toner thereon are hidden under the toner, and no light is reflected from the parts. Accordingly, as for the relationship between the amount of toner of a density patch and the amount of specularly reflected light, the amount of specularly reflected light decreases with an increase in the amount of toner, as shown in FIG. 10. The type of density sensor which detects specularly reflected light does not detects light reflected from toner but mainly detects light reflected from a background. The density sensor can perform density detection regardless of the colors of the toner and base and has an advantage over the type of density sensor which detects diffusely reflected light. Since the amount of reflected light of specular reflection components is generally larger than that of reflected light of diffused reflection components, the type of density sensor which detects specularly reflected light also has an advantage in detection precision. For this reason, it is desirable to use the type of density sensor which detects specularly reflected light when performing density detection on a photosensitive member.

However, if the type of density detecting sensor which detects specularly reflected light detects toner of a chromatic color, a following problem occurs. When a density patch for toner of a chromatic color is irradiated with light, diffusely reflected light increases with an increase in the amount of toner. As described above, the diffusely reflected light diffuses uniformly in all directions. Accordingly, light detected by the type of density sensor is the sum of specular reflection components and diffused reflection components.

Figure 11:
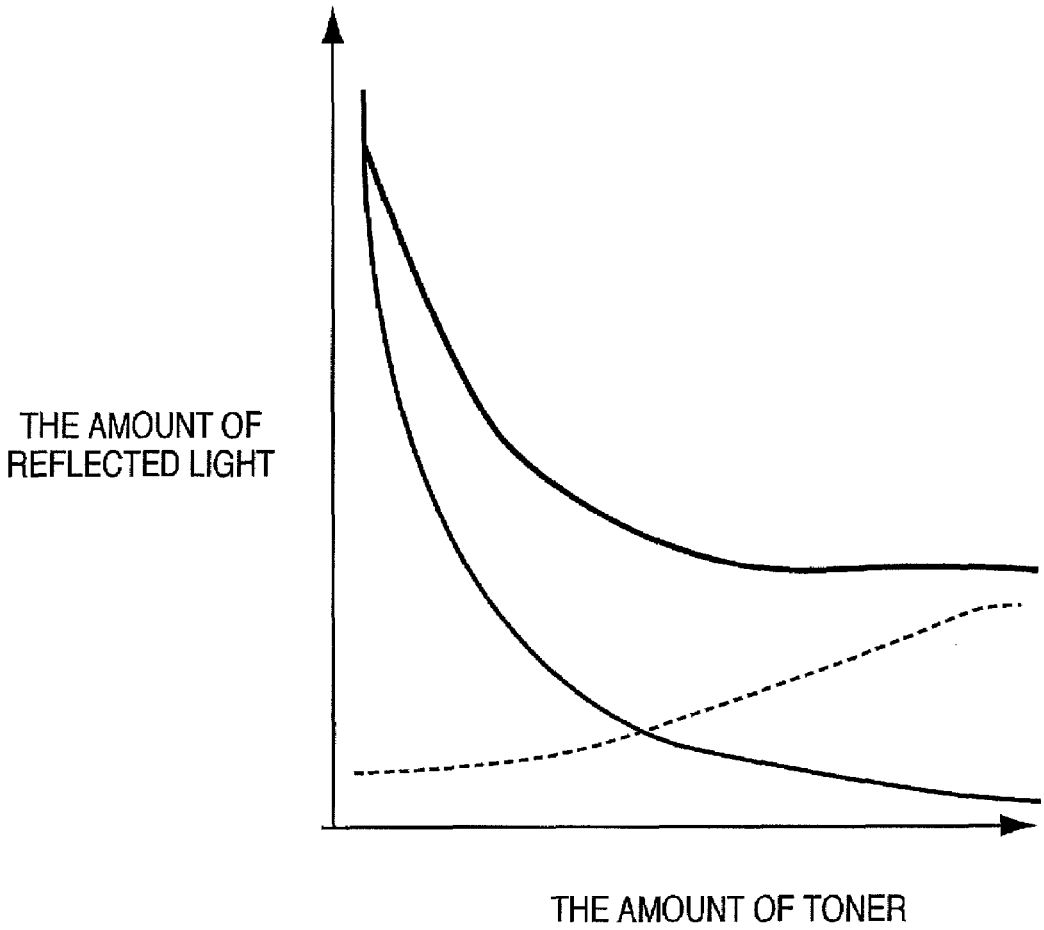
FIG. 11 is a graph showing an example of the relationship between the amount of reflected light if toner of a chromatic color is detected by a density detecting sensor of a specularly reflected light detection type, and the amount of toner, applied to the image forming apparatus of this embodiment.

FIG. 11 shows the relationship between the amount of toner and the amount of reflected light at this time. The relationship is the sum of a thin solid line representing the characteristic of specular reflection and a broken line representing the characteristic of diffused reflection to form a negative characteristic indicated by a thick solid line.

Figure 12:
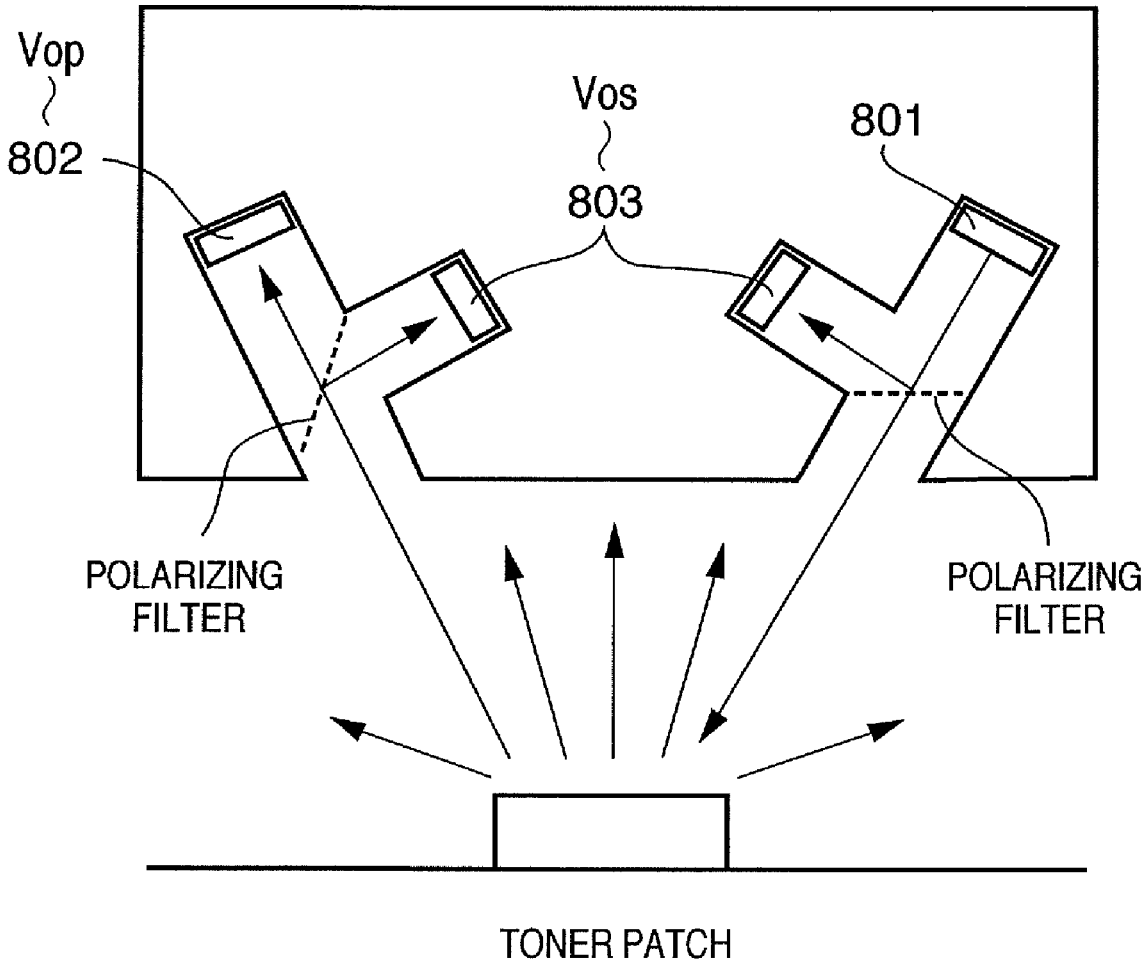
FIG. 12 is a view showing an example of the structure of an optical sensor as a density detecting sensor of this embodiment.

Thus, to take advantage of the characteristics of both specularly reflected light and diffusely reflected light, the density detecting sensor 200 as detection means used in the image forming apparatus of this embodiment is configured as shown in FIG. 12. More specifically, the density detecting sensor 200 is composed of one light-emitting element (LED) 801, a light-receiving element (photodiode) Vop 802 for specularly reflected light components of irradiation light, and light-receiving elements Vos 803 for diffusely reflected light components. The light-receiving element Vop 802 is provided at a location where it can detect reflected light component of irradiation light from the light-emitting element 801, which component is reflected on the conveying belt at the same angle as the irradiation light. Each of the light-receiving elements Vos 803 is provided at a location where it can detect reflected light components of the irradiation light from the light-emitting element 801, which components are reflected by a density patch on the conveying belt through a polarizing filter.

In a density sensor of a specularly reflected light detection type which mainly detects light reflected from a background, if the surface state of the background varies with an amount of use, the amount of specularly reflected light varies accordingly. Accordingly, it is effective to perform correction such as normalizing the amount of light reflected from each density patch using the amount of light reflected from a background and converting the normalized amount into density information (to be referred to as background correction hereinafter). Measurement of the amount of light reflected from a background for background correction is desirably performed at the same time and at the same location as formation of each density patch in consideration of unevenness of the material of the conveying belt and status change of the conveying belt for elapsed time.

Figure 13:
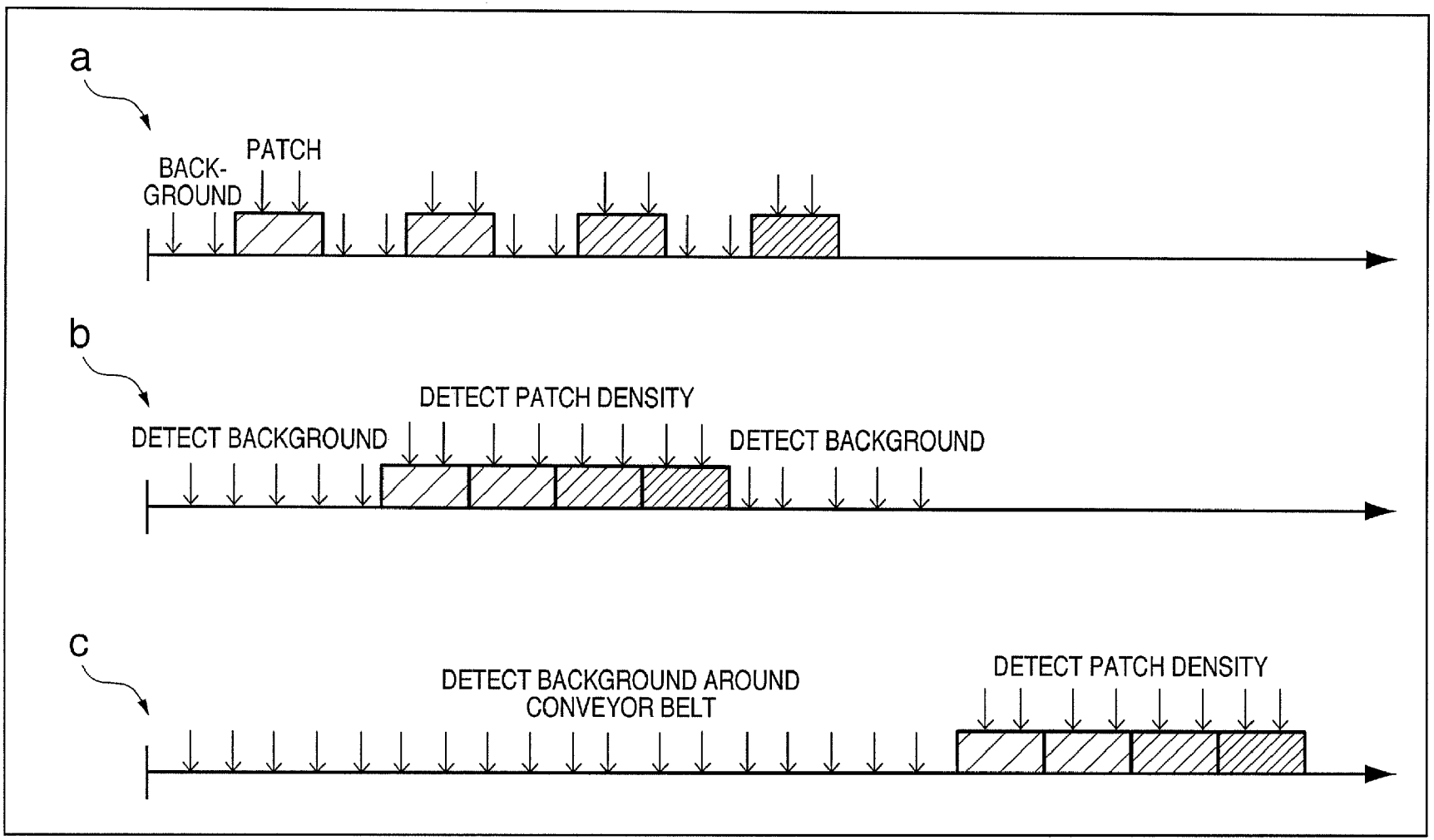
FIG. 13 shows views for explaining methods of measuring the amount of light reflected from a background which are applied to the image forming apparatus of this embodiment.

Examples of a method of measuring the amount of light reflected from a background include the following methods. The first one is a method of alternately measuring a density patch and the amount of light reflected from the background, as shown in a of FIG. 13. The second one is a method of measuring the amount of light reflected from the background both in front of and behind density patches, as shown in b of FIG. 13. The third one is a method of measuring the amount of light reflected from the background around a conveying belt and then forming density patches, as shown in FIG. c of 13. In this embodiment, patch images are formed by the method of a FIG. 13.

Figure 14:
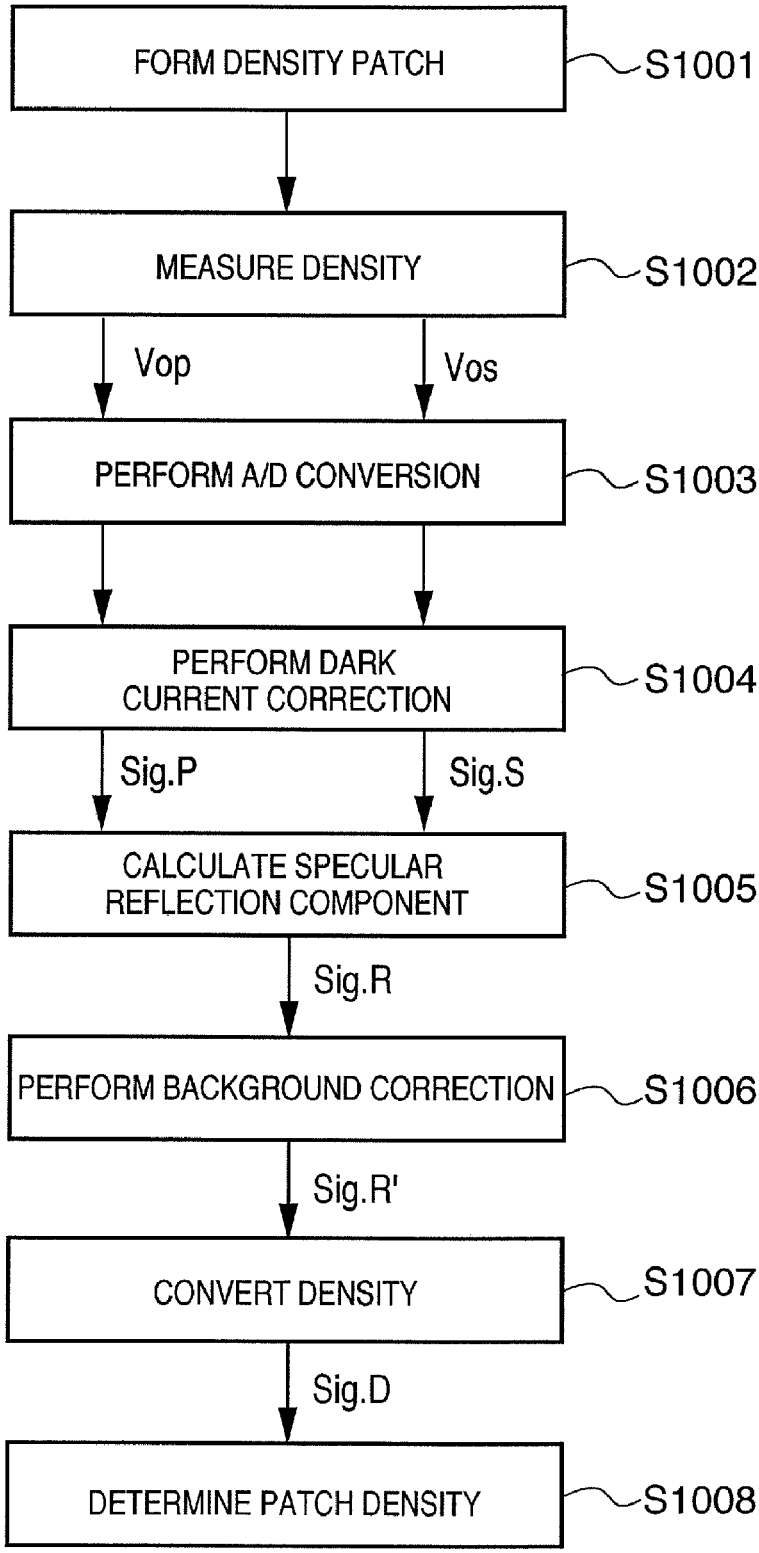
FIG. 14 is a flowchart showing an example of the procedure for patch density measurement operation performed in this embodiment.

Referring back to FIG. 6, the procedure for patch density detection (S323) will be explained with reference to FIG. 14.

Figure 15:
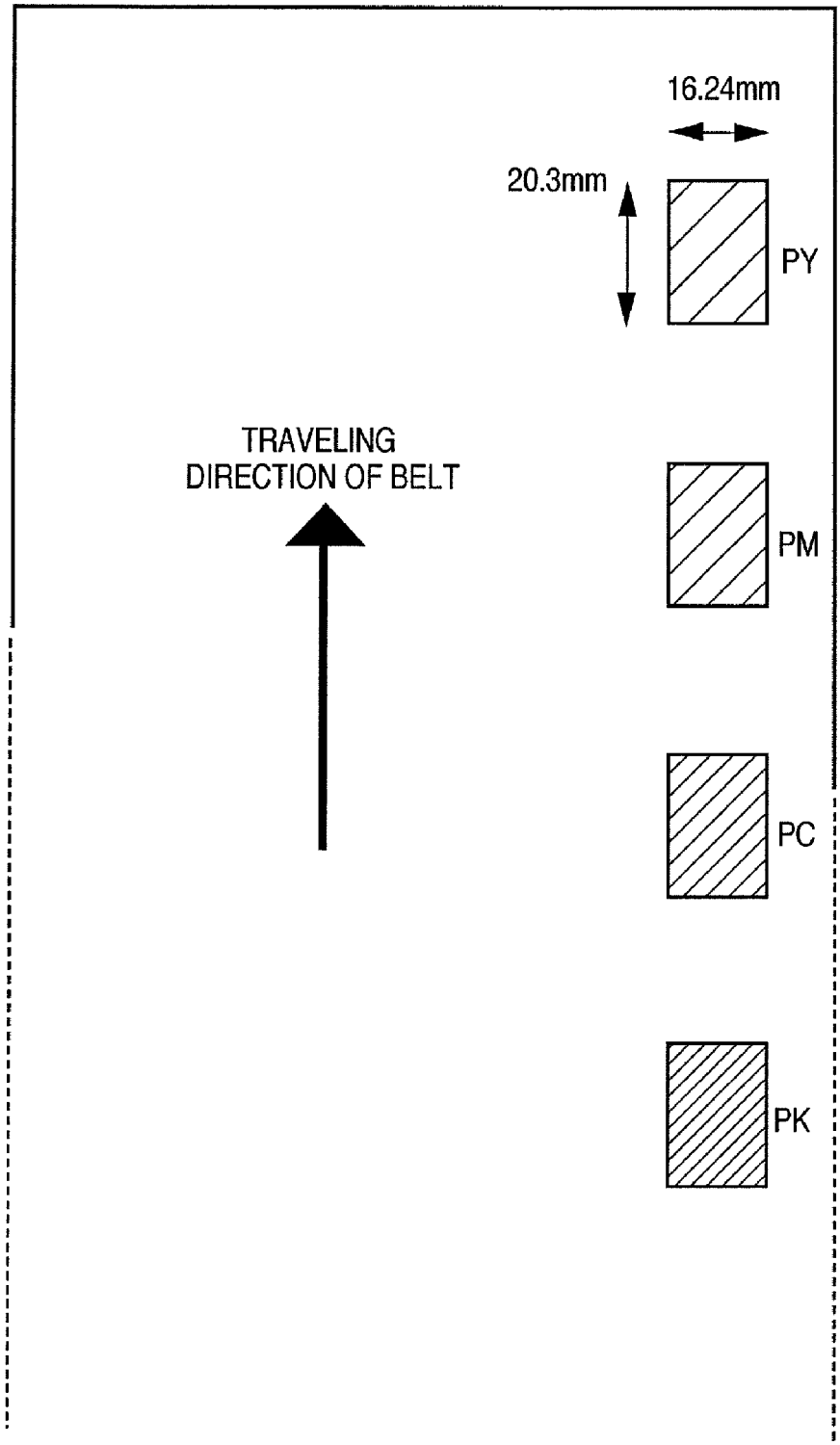
FIG. 15 is a view showing an example of density patch images used in this embodiment.

S1001: Yellow, magenta, cyan, and black density patches PY, PM, PC, and PK are first formed in a line in the longitudinal direction on the conveying belt 201 using patch image data generated from the test pattern generating unit 216. FIG. 15 is a view showing the sizes of the density patches. In this embodiment, the size of each density patch is 16.24 mm in the main scanning direction and 20.3 mm in the sub-scanning direction, as shown in FIG. 15.

S1002: The density detecting sensor 200 measures the densities of the density patches PY, PM, PC, and PK. As shown in FIG. 12, the density of each density patch is detected by detecting diffusely reflected light components with the light-receiving element Vop and detecting specularly reflected light components with the light-receiving elements Vos. The density detecting sensor 200 detects the densities of eight points at sampling intervals of 15 ms while each of the density patches on the conveying belt 201 passes through the detection area of the density detecting sensor 200.

S1003: The mean value of the density values of six points obtained by excluding the maximum one and minimum one from the eight points is a detection result of the density detecting sensor 200. The detection results are A/D converted by the A/D conversion unit 215 and the A/D converted results are stored into the RAM 212 in the image forming apparatus.

S1004: After that, dark current correction is performed to eliminate the influences of factors other than patch density detection from the detection results of the density detecting sensor 200. This correction procedure comprises the steps of measuring outputs from the light-receiving elements 802 and 803 while keeping the light-emitting element 801 of the density detecting sensor 200 in a non-light-emitting state, and subtracting the results in the non-light-emitting state from the results of measuring the density patches, thereby eliminating the influences of factors other than patch density detection from the measurement results. The detection results after the dark current correction are stored into the RAM 212 as diffusely reflected light component measurement results Sig.PY, Sig.PM, Sig.PC, and Sig.PK and specularly reflected light component measurement results Sig.SY, Sig.SM, Sig.SC, and Sig.SK (not shown). After the density measurement, the density patches are cleaned off from the conveying belt by a belt cleaner.

S1005: Specular reflection components are calculated from the diffusely reflected light component measurement results and specularly reflected light component measurement results. The expression for the calculation is represented by:

$$\mathrm{Sig}.R=\mathrm{Sig}.P-k1\times\mathrm{Sig}.S$$

where k1 is a specular reflection component detection coefficient. The coefficient K1 varies depending on the characteristics and installation location of the density detecting sensor and is determined such that Sig.R is 0 when the density patch for each color toner has been measured. In this embodiment, coefficients for colors k1Y, k1M, k1C, and k1K are set to 0.254, 0.241, 0.23, and 0, respectively. The fact that k1=0 implies that the corresponding diffusely reflected light component measurement result of the density detecting sensor is ignored, and only the corresponding specularly reflected light component measurement result is used for image patch density detection.

S1006: Specular reflection components of the conveying belt alone are measured without forming a density patch, and the measurement result is represented by Sig.RB. The influence of the surface state of the background is eliminated by normalizing Sig.R using the measurement result Sig.RB. The calculation expression for the normalization is represented by:

$$\mathrm{Sig}.R'=A\times\mathrm{Sig}.R/\mathrm{Sig}.RB$$

where A is a constant for normalization. In this embodiment, since an image density is controlled in units of ten bits, a hexadecimal value of 3FF (=1,023) is used as the constant A.

Figure 16:
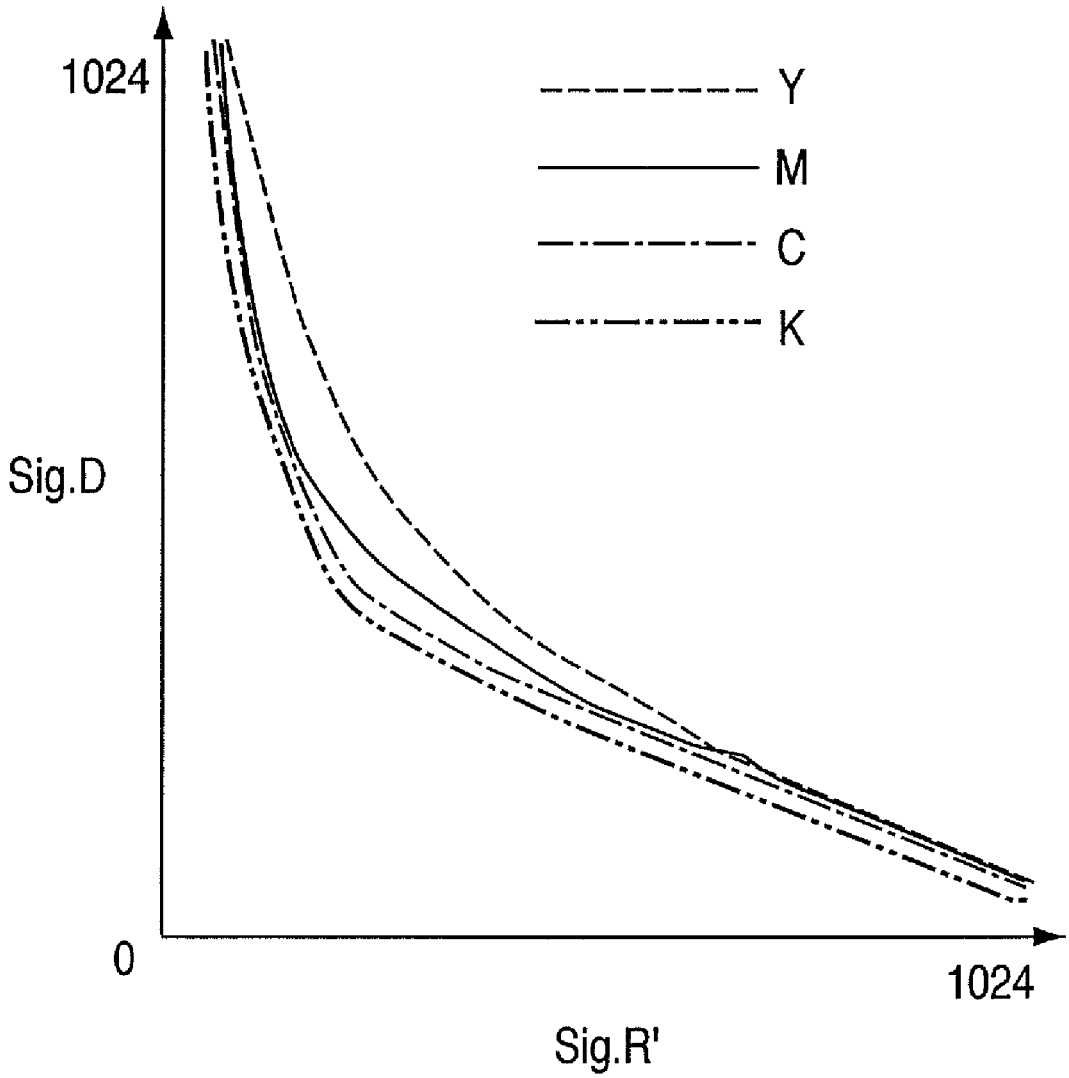
FIG. 16 is a graph showing an example of a density conversion table used in this embodiment.

S1007: For example, when the density patch of black is measured, since the diffusely reflected light component measurement result Sig.PK ≈0, Sig.R' obtained in step S1006 becomes nearly equal to 0. That is, the higher the density of each density patch, the smaller the value of Sig.R'. Accordingly, Sig.R' is converted using a conversion table as shown in FIG. 16 such that Sig.R' is proportional to an image density.

S1008: A patch image density Sig.D is determined.

Referring back to FIG. 6, each of the obtained patch image densities is compared with a target value (S324).

A target value is preset for each color. The patch image densities higher than the corresponding target values means that the T/C ratio in each of the developing units 113*a* to 113*d* is higher than the corresponding optimum value. On the other hand, the patch image densities lower than the corresponding target values means that the TIC ratio in each of the developing units 113*a* to 113*d* is lower than the corresponding optimum value. Accordingly, a correction value for the amount of toner to be replenished in each developing unit is calculated on the basis of the difference between the patch image density and the target value (S325). In toner replenishment 330, toner replenishment is performed using a combination of the correction values and the block replenishment amounts calculated from the video counts. This makes it possible to keep the T/C ratio in each of the developing units 113*a* to 113*d* optimum.

<Example of Shortening of Image Density Adjustment Operation as One Example of Adjustment Shortening of This Embodiment>

As another example, a modification will be explained, taking adjustment operation of adjusting the potential on each of the photosensitive drums 111*a* to 111*d*.

An amorphous silicon photosensitive drum is used as a photosensitive drum of this embodiment. This is because an amorphous silicon photosensitive drum has advantages over a commonly used organic photo conductor (OPC) photosensitive drum. The advantages include resistance to surface abrasion caused by continuous use and excellent durability, and also high dot reproducibility. However, an amorphous silicon photosensitive drum also has a disadvantage in that the dark decaying rate is high. Dark decaying is a phenomenon in which after a photosensitive drum is charged by charging means, the potential of the surface of the photosensitive drum decreases with elapsed time. Since dark decaying causes a change in image formation conditions such as exposure conditions and development conditions, if the image formation conditions such as the exposure conditions and development conditions are always kept constant, an image defect such as fogging or a reduction in the density of a visible image appears. For this reason, each time when a given time elapses or a given amount of printout is produced by print operation, a surface potentiometer opposing a photosensitive drum measures the potential on the photosensitive drum, thereby controlling pre-exposure conditions and the like on the basis of the measurement result. In this embodiment, a surface potential sensor measures surface potentials Vd1 and Vd2 of the photosensitive drum with respect to two primary current values lp1 and lp2, respectively. An amount of pre-exposure is controlled according to a body-to-body difference and drum-to-drum difference or a change for elapsed time, using (Vd2−Vd1)/(lp2−lp1)=α.

Figure 17:
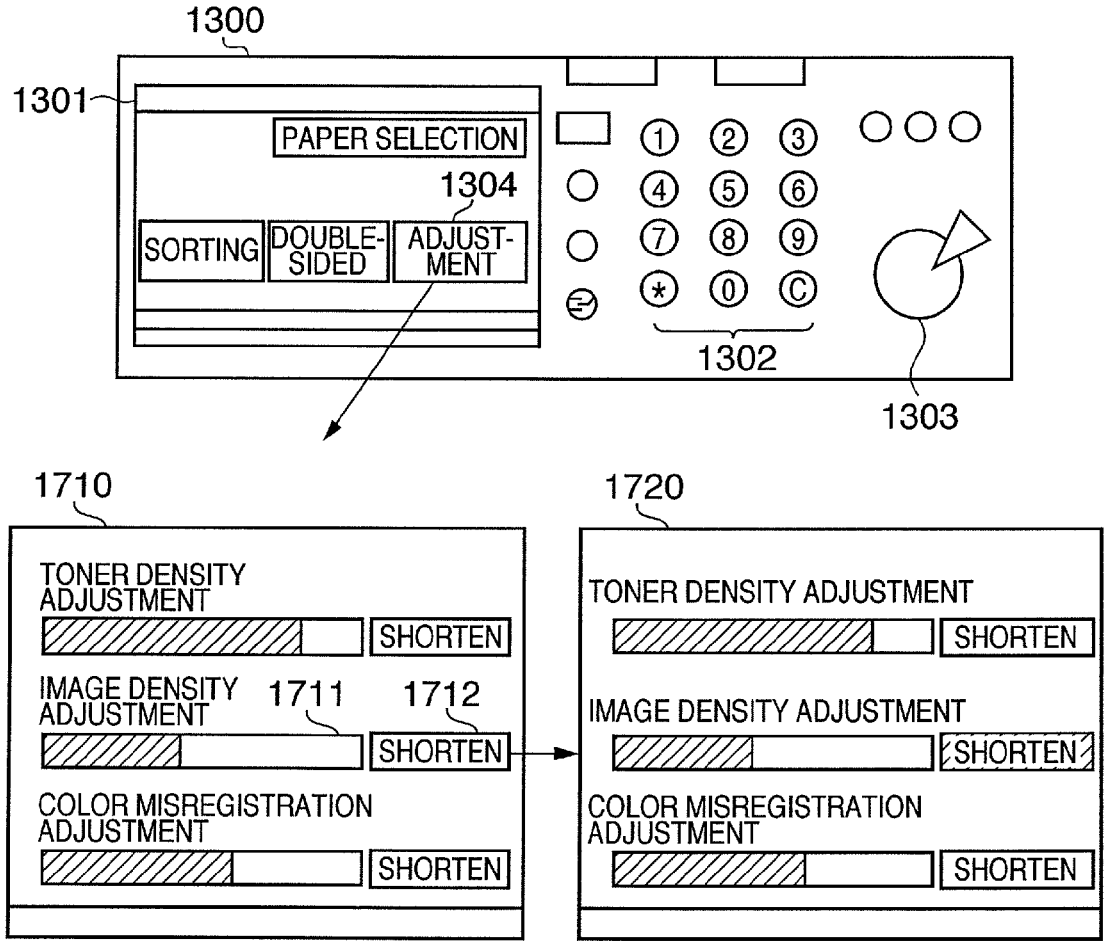
FIG. 17 is a view for explaining an example of adjustment timing and shortening of adjustment time in an operation panel according to this embodiment.

FIG. 17 shows the configuration of the operation panel provided on the front of the image reader 400, as in FIG. 4. For easy operation by users, each adjustment operation displayed on the operation panel is not named according to the kind of the adjustment operation but preferably named according to the effect of the adjustment operation. Drum potential adjustment operation is named as image density adjustment operation because an image density changes depending on the result of the drum potential adjustment operation.

When the adjustment timing display key 1304 is pressed, the initial display of the operation panel changes to a screen 1710. In the case of drum potential adjustment operation described above, the right end of the filled portion of the corresponding timing bar 1711 indicates the number of output sheets that have been printed since the last drum potential adjustment operation. The right end of the timing bar 1711 indicates an accumulative value of 100 output sheets, which is a threshold value for execution of drum potential adjustment operation. Accordingly, when the filled portion of the timing bar 1711 has reached the right end, the condition for execution of the adjustment operation is satisfied, and the drum potential adjustment operation is automatically executed.

Reference numeral 1712 denotes an adjustment shortening key. When the key 1712 is pressed, the time required for the corresponding adjustment operation is shortened. Note that as for shortening of the adjustment operation, a specific example of normal adjustment operation and one of shortened adjustment operation will be shown.

If the adjustment shortening key 1712 is pressed by a user before or at the start of a print job, the execution time of the corresponding adjustment operation is shortened as described above, and then the print job is executed. Although the adjustment operation is shortened so as to have no influence on an output image, it is undesirable not to perform normal adjustment operation for a long period. Accordingly, even if the adjustment shortening key 1712 is pressed, unshortened drum potential adjustment operation is performed once out of five times of drum potential adjustment operations. Also, even if the adjustment shortening key 1712 has been pressed, unshortened adjustment operation is executed at the end of the print job.

(Normal Image Density Adjustment Operation)

Figure 18:
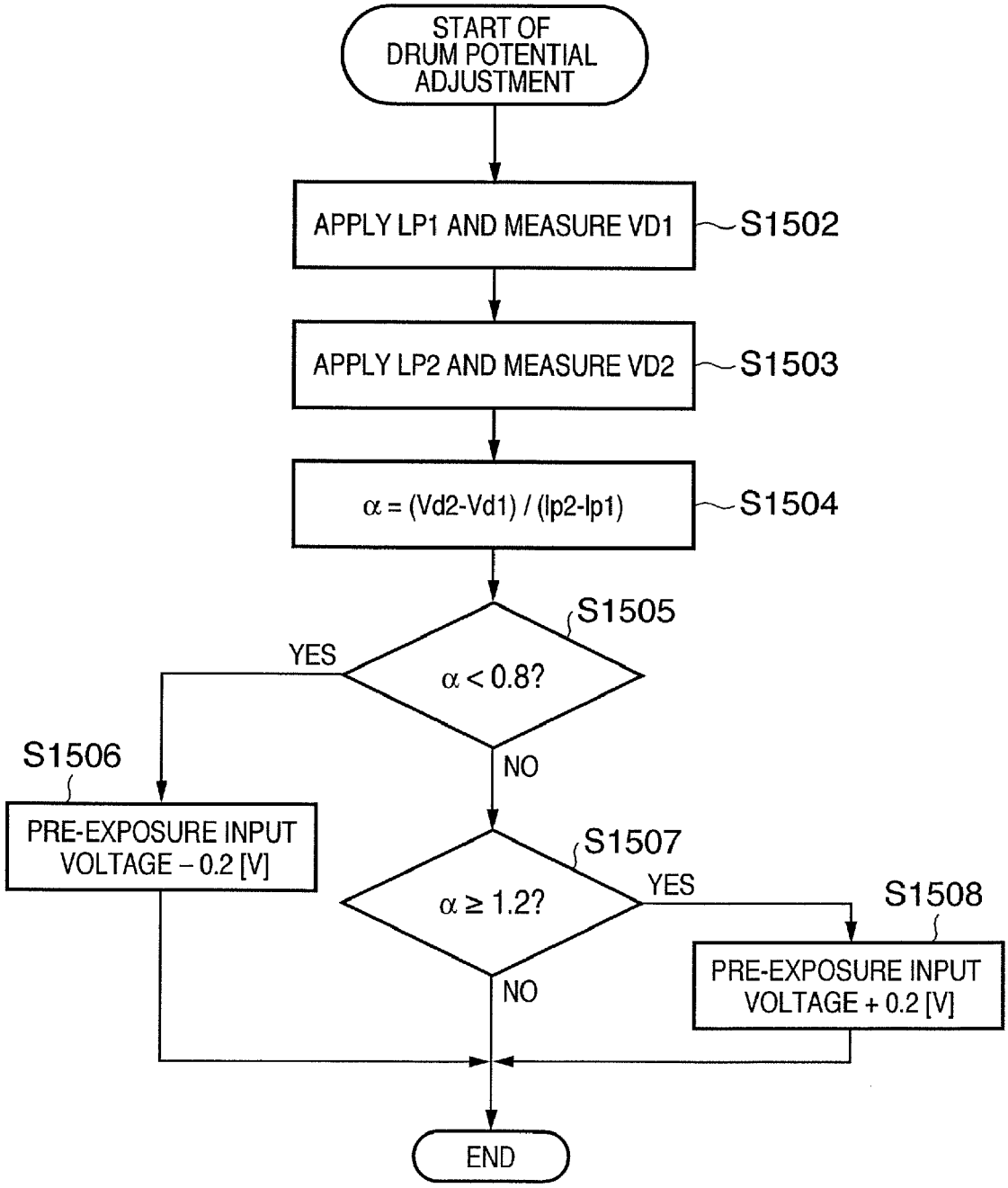
FIG. 18 is a flowchart showing the procedure for normal drum potential adjustment operation according to this embodiment.

FIG. 18 is a flowchart showing an example of the procedure for normal image density adjustment operation.

A primary charging current of 800 μA is first applied, and then the drum surface potential Vd1 is measured around each photosensitive drum (S1502). After a primary charging current of 1,200 μA is next applied, the drum surface potential Vd2 is also measured around the photosensitive drum (S1503). The value a is calculated by $\alpha=(Vd2-Vd1)/(1{,}200-800)$ (S1504). Whether $\alpha<0.8$ (S1505) and whether $\alpha\geqq1.2$ (S1507) are determined. If $\alpha$ is not less than 0.8 and less than 1.2, a pre-exposure input voltage is kept unchanged.

If $\alpha$ is less than 0.8, the pre-exposure input voltage is reduced by 0.2 V (S1506). The steps are repeated until $\alpha$ becomes not less than 0.8 and less than 1.2. If $\alpha$ falls within the range of $0.8\leqq\alpha<1.2$, pre-exposure at this time is selected.

Similarly, if $\alpha$ is not less than 1.2, the pre-exposure input voltage is increased by 0.2 V (S1508). If $\alpha$ after the change of the pre-exposure input voltage is still not less than 1.2, the pre-exposure input voltage is further increased by 0.2 V (S1508). The steps are repeated until $\alpha$ becomes not less than 0.8 and less than 1.2. If a falls within the range of $0.8\leqq\alpha<1.2$, the pre-exposure at this time is selected.

The permissible range of $\alpha$ is set to the range of $0.8\leqq\alpha<1.2$ on the basis of the following idea.

The lower limit of $\alpha$, amin is set to 0.8 to secure charging power. That is, a value of $\alpha$, with which a target charging potential is obtained by using the utmost capability of a charging device even under a combination of the hardest conditions as charging conditions within tolerance concerning a main body, drum, environment, charging device, and the like, is set as amin. The upper limit of $\alpha$, $\alpha$max is set to 1.2, which is a value of $\alpha$, with which a permissible potential level for image memory phenomenon (to be explained below) is obtained. Image memory phenomenon refers to a phenomenon in which traces of a previously formed image remain on the photosensitive member.

In this modification, the permissible potential level for image memory phenomenon is set to 5 V. The value was determined as follows. A permissible potential level was selected from different potential levels for image memory phenomenon on the basis of subjective evaluation. In an image of the permissible potential level, a density difference $\Delta D$ between a portion of the image under non-image memory phenomenon and a portion of the image under image memory phenomenon was measured. Note that $\Delta D$ was equal to 0.05.

Figure 19:
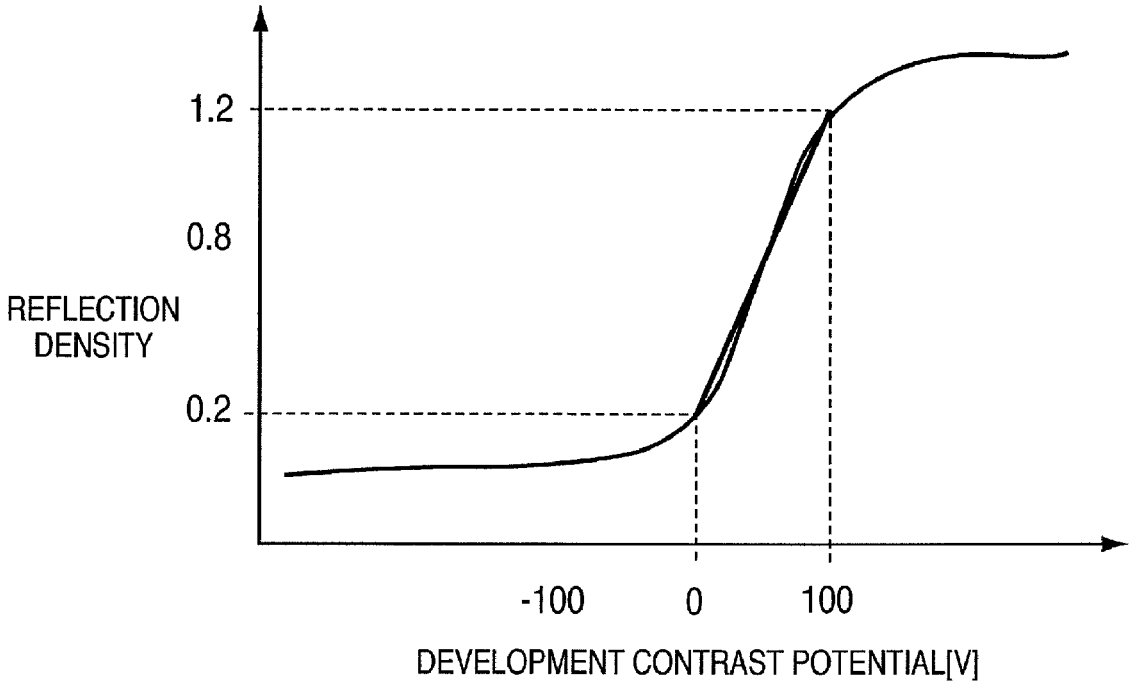
FIG. 19 is a graph showing an example of the relationship of density to development contrast potential in drum potential adjustment operation according to this embodiment.

FIG. 19 shows the relationship of density to development contrast potential as a development characteristic of the image forming apparatus of this modification. The maximum value of a density variation (to be referred to as a "development $\gamma$" hereinafter) with respect to a development contrast potential variation was 0.01/V, as can be seen from FIG. 19. Accordingly, the permissible potential level for image memory phenomenon was determined to be 5 V (=0.05/0.01). The value of $\alpha$ at this time was selected as $\alpha$max. The values $\alpha$min, $\alpha$, and $\alpha$max ($\alpha\text{min}\leqq\alpha\leqq\alpha\text{max}$) thus obtained can be similarly set even if various conditions concerning a main body, drum, and the like change.

In this embodiment, the pre-exposure is controlled according to a change for elapsed time or a body-to-body difference and drum-to-drum difference, using $\Delta Vd/\Delta lp$ (=$\alpha$) obtained by measuring the drum surface potentials Vd1 and Vd2 with respect to the two primary current values lp1 and lp2 by a surface potentiometer 41. For this reason, a good image which is free from image memory phenomenon and has a high density contrast derived from sufficient charging potential can be optimally formed according to a durability deterioration for elapsed time or a body-to-body difference and drum-to-drum difference. Note that in this embodiment, drum potential adjustment operation described above is executed each time when the number of printed sheets reaches 100.

(Shortened Image Density Adjustment Operation)

Figure 20:
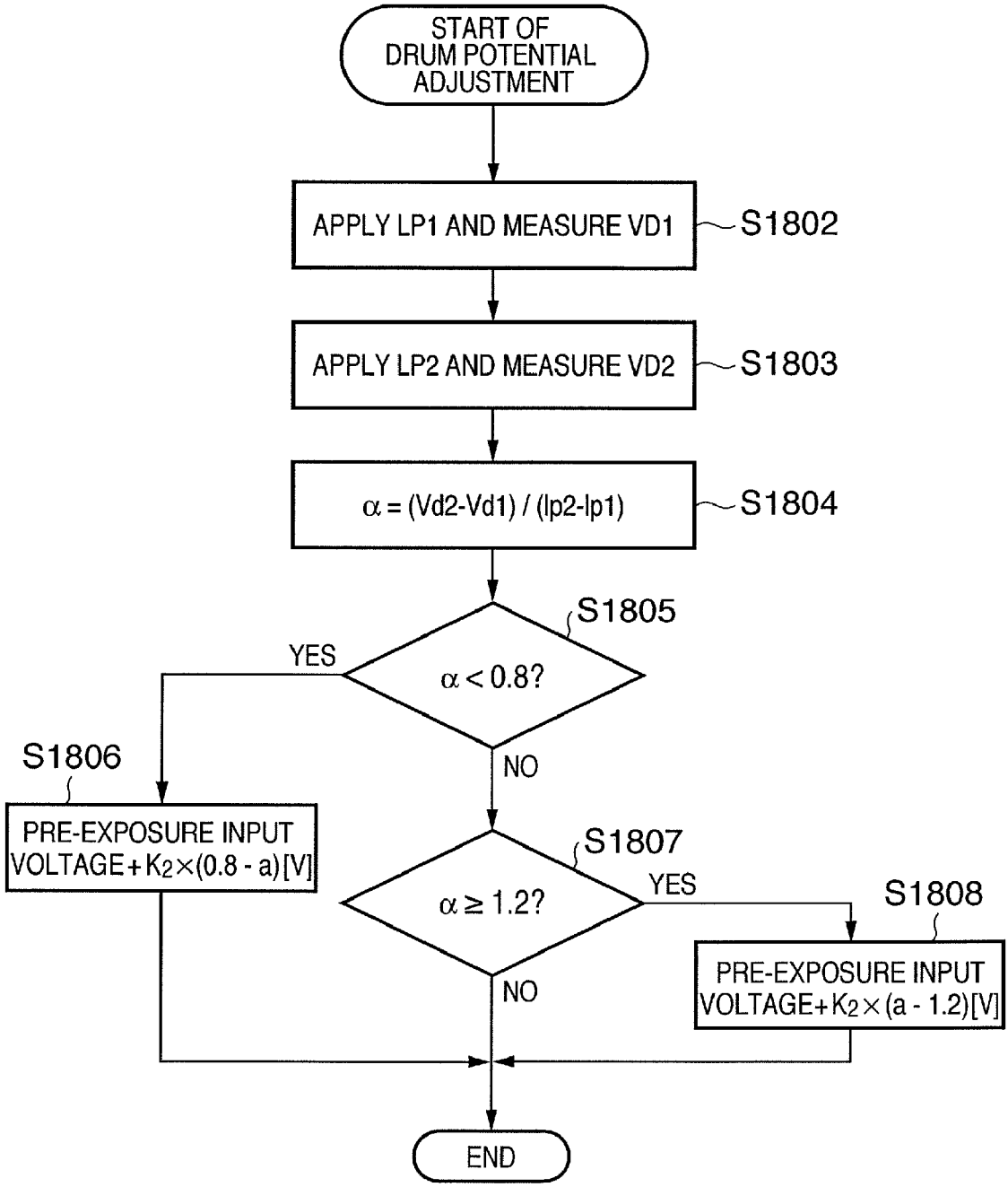
FIG. 20 is a flowchart showing an example of the procedure for a shortened version of drum potential adjustment operation according to this embodiment.

FIG. 20 is a flowchart showing the procedure for shortened image density adjustment operation (drum potential adjustment operation). Note that steps S1802 to S1805 and S1807 are the same as steps S1502 to S1505 and S1507 in FIG. 18.

If $\alpha$ is less than 0.8, the pre-exposure input voltage is reduced by $k2\times(0.8-\alpha)$ [V] using a coefficient k2 for varying the pre-exposure input voltage (S1806). If $\alpha$ is not less than 1.2, the pre-exposure input voltage is increased by $k2\times(\alpha-1.2)$ (S1808). The change from FIG. 18 to FIG. 20 in control reduces the number of times at which the steps are repeated (repetition time) until $\alpha$ becomes not less than 0.8 and less than 1.2.

As another example, when the adjustment shortening key 1712 is pressed, the drum surface potentials Vd1 and Vd2 may be measured halfway around the photosensitive drum or at several points on the photosensitive drum in step S1802 and/or S1803, and the drum surface potentials Vd1 and Vd2 may be determined using the measurement results. Since the measurement is not performed around the drum, the time required for adjustment operation is shortened.

Note that this embodiment has shown adjustment interval "extension" and adjustment "shortening" for each of toner density adjustment operation and image density adjustment operation (drum potential adjustment operation). However, the present invention is not limited to this. The present invention also includes interval "extension" and "shortening" of color misalignment adjustment operation shown in, e.g., FIGS. 4 and 17 and other adjustment operations.

Figure 21:
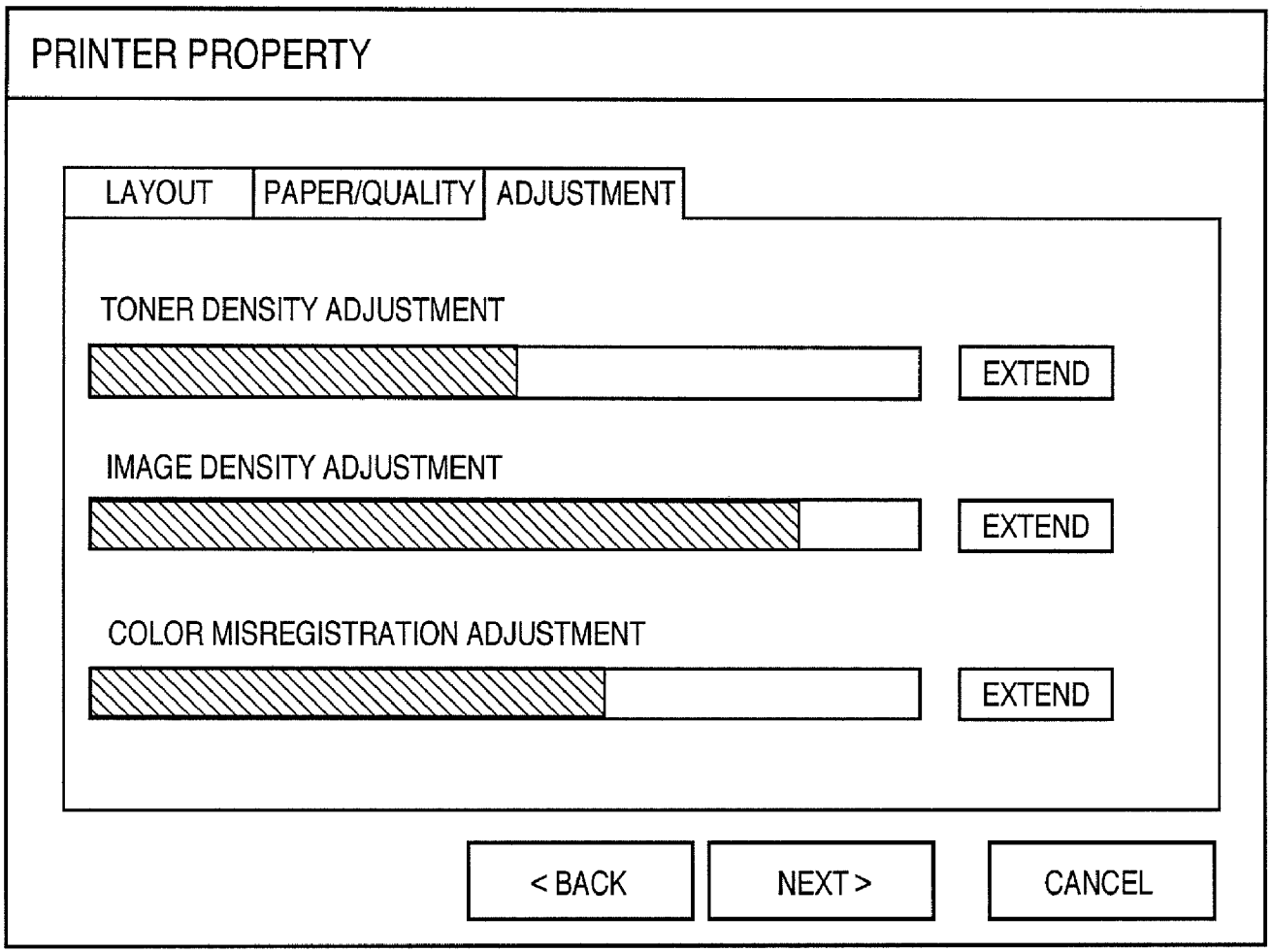
FIG. 21 is a view showing an example of a printer operation unit panel in a host computer according to this embodiment.

This embodiment has used a copying machine as an image forming apparatus and explained an operation unit panel and keys on the panel as notification means for notifying a user of a time at which adjustment operation is to be performed and adjustment shortening setting means. However, if the image forming apparatus is a printer, the same control as this embodiment can be implemented by providing the notification means and adjustment shortening setting means on a PC screen, as shown in FIG. 21, and notifying the image forming apparatus of input data.

In other words, the present invention can be applied to a system or integrated apparatus composed of a plurality of devices (e.g., a host computer, interface device, printer, and the like) or an apparatus composed of a single device.

The present invention is not limited to an image forming apparatus and implements a reduction in the time for adjustment operation during processing in an apparatus which performs adjustment operation during processing without any degradation in the quality of processing. An apparatus of performing such a technical idea is also included in the present invention.

Needless to say, the object of the present invention is also achieved by supplying a storage medium (or recording medium) having recorded thereon a software program code of performing the functions of the above-described embodiment to a system or apparatus and scanning out and executing the program code stored in the storage medium by a computer (or a CPU or MPU) of the system or apparatus. In this case, the program code itself read out from the storage medium implements the functions of the embodiment, and the storage medium storing the program code constitutes the present invention. The functions of the embodiment are implemented not only by executing the read-out program code by the computer. The present invention, of course, includes a case where an operating system (OS) running on the computer performs part or all of actual processing in accordance with the instructions of the program code, thereby performing the functions of the embodiment.

The present invention further includes a case where the program code read out from the storage medium is written to memory of a function extension card or function extension unit which is inserted in or connected to the computer, and a CPU or the like of the function extension card or function extension unit performs part or all of actual processing in accordance with the instructions of the program code, thereby performing the functions of the embodiment.

If the present invention is applied to the storage medium, program codes including a program code corresponding to the flowcharts explained above are stored in the storage medium.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-293006, filed on Oct. 5, 2005, which is hereby incorporated by reference herein in its entirety.

What is claimed is:

1. An apparatus which performs adjustment operation at a predetermined timing, comprising:

monitoring unit adapted to monitor a timing at which the adjustment operation is to be performed;

notification unit adapted to visually notify a user of the timing at which the adjustment operation is to be performed before execution of a job requested by the user;

setting unit adapted to set an adjustment time reduction mode of reducing a time for the adjustment operation during execution of the job requested by the user; and control unit adapted to, when the adjustment time reduction mode is set by said setting unit, cause the apparatus to operate in the adjustment time reduction mode until the job is completed.

2. The apparatus according to claim 1, wherein in the adjustment time reduction mode, the time for the adjustment operation during execution of the job is reduced by making an interval to perform the adjustment operation longer than a normal interval of adjustment operation execution.

3. The apparatus according to claim 1, wherein in the adjustment time reduction mode, the time for the adjustment operation during execution of the job is reduced by performing adjustment operation executable for a shorter time than a time required for normal adjustment operation.

4. The apparatus according to claim 1, wherein the adjustment operation which has not been performed due to the adjustment time reduction mode is performed after the end of the job, for which the adjustment time reduction mode is set.

5. An image forming apparatus which performs adjustment operation at a predetermined timing, comprising:

monitoring unit adapted to monitor a timing at which the adjustment operation is to be performed;

notification unit adapted to visually notify a user of the timing at which the adjustment operation is to be performed before execution of a job requested by the user;

setting unit adapted to set an adjustment time reduction mode of reducing a time for the adjustment operation during execution of the job requested by the user; and control unit adapted to, when the adjustment time reduction mode is set by said setting unit, cause the apparatus to operate in the adjustment time reduction mode until the job is completed.

6. The image forming apparatus according to claim 5, wherein in the adjustment time reduction mode, the time for the adjustment operation during execution of the job is reduced by making an interval to perform the adjustment operation longer than a normal interval of adjustment operation execution.

7. The image forming apparatus according to claim 6, wherein the adjustment operation includes toner density adjustment operation for adjusting the amount of toner to be replenished, and in the adjustment time reduction mode, a time interval, at which adjustment operation for forming a toner patch image and correcting the amount of toner to be replenished on the basis of a density value of the toner patch image detected by density detection means is performed, is extended by increasing a threshold value for a printed dot count, which is a condition for execution of the adjustment operation.

8. The image forming apparatus according to claim 5, wherein in the adjustment time reduction mode, the time for the adjustment operation during execution of the job is reduced by performing adjustment operation executable for a shorter time than a time required for normal adjustment operation.

9. The image forming apparatus according to claim 8, wherein the adjustment operation includes image density adjustment operation for adjusting a potential of a photosensitive drum, and in the adjustment time reduction mode, a time, for which adjustment operation for controlling a pre-exposure condition such that a charging characteristic of the photosensitive drum falls within a predetermined range is performed, is shortened by reducing the number of times at which measurement of the charging characteristic and change of the pre-exposure condition are repeated.

10. The image forming apparatus according to claim 5, wherein the adjustment operation includes color misalignment adjustment operation for correcting color misalignment of a color component at the time of color image formation.

11. The image forming apparatus according to claim 5, wherein the adjustment operation which has not been performed due to the adjustment time reduction mode is performed after the end of the job, for which the adjustment time reduction mode is set.

12. A method of controlling an apparatus which performs adjustment operation at a predetermined timing, comprising the steps of:

monitoring a timing at which the adjustment operation is to be performed;

visually notifying a user of the timing at which the adjustment operation is to be performed before execution of a job requested by the user;

setting an adjustment time reduction mode of reducing a time for the adjustment operation during execution of the job requested by the user; and causing the apparatus to operate in the adjustment time reduction mode until a job is completed, when the adjustment time reduction mode is set in the setting step.

13. The method according to claim 12, wherein the apparatus is an image forming apparatus, the adjustment operation includes toner density adjustment operation for adjusting the amount of toner to be replenished, and in the adjustment time reduction mode, a time interval, at which adjustment operation for forming a toner patch image and correcting the amount of toner to be replenished on the basis of a density value detected by density detection means is performed, is extended by increasing a threshold value for a printed dot count, which is a condition for execution of the adjustment operation.

14. The method according to claim 12, wherein the apparatus is an image forming apparatus, the adjustment operation includes image density adjustment operation for adjusting a potential of a photosensitive drum, and in the adjustment time reduction mode, a time, for which adjustment operation for controlling a pre-exposure condition such that a charging characteristic of the photosensitive drum falls within a predetermined range is performed, is shortened by reducing the number of times at which measurement of the charging characteristic and change of the pre-exposure condition are repeated.

* * * * *